US006438395B1

(12) United States Patent
Hidaka et al.

(10) Patent No.: US 6,438,395 B1
(45) **Date of Patent: *Aug. 20, 2002**

(54) HIGH FREQUENCY LOW LOSS ELECTRODE WITH MAIN AND SUB CONDUCTORS

(75) Inventors: Seiji Hidaka, Nagaokakyo; Shin Abe, Muko; Michiaki Ota, Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/387,331

(22) Filed: Aug. 31, 1999

(30) Foreign Application Priority Data

Sep. 1, 1998 (JP) ..... 10-246991

(51) Int. Cl.[7] ..... H01P 1/213; H01P 1/203; H01P 3/08; H01B 12/02

(52) U.S. Cl. ..... 505/210; 333/134; 333/204; 333/219; 55/700; 55/701; 55/866

(58) Field of Search ..... 333/238, 246, 333/995, 204, 219, 134; 505/210, 700, 701, 866

(56) References Cited

U.S. PATENT DOCUMENTS 6,144,268 A * 11/2000 Matsui ..... 333/246 X

FOREIGN PATENT DOCUMENTS

| | | |
|---|---|---|
| CA | 2148341 | 2/1997 |
| EP | 0741432 A2 | 11/1996 |
| EP | 0812025 A1 | 12/1997 |
| JP | 08321706 | 12/1996 |
| JP | 09093005 | 4/1997 |

OTHER PUBLICATIONS

Canadian Office Action dated Mar. 1, 2002.

* cited by examiner

*Primary Examiner*—Benny T. Lee
(74) *Attorney, Agent, or Firm*—Ostrolenk, Faber, Gerb & Soffen LLP

(57) ABSTRACT

A high frequency electrode includes a main conductor and at least two sub-conductors formed along a side of the main conductor. The sub-conductors are formed so that a sub-conductor thereof positioned nearer to the outside has a smaller width.

28 Claims, 18 Drawing Sheets

HIGH FREQUENCY LOW LOSS ELECTRODE WITH MAIN AND SUB CONDUCTORS

CROSS-REFERENCE TO RELATED APPLICATION

This application is related to the same inventors' commonly-assigned U.S. Ser. No. 09/386,637 filed on Aug. 31, 1999, also titled HIGH FREQUENCY LOW LOSS ELECTRODE, the disclosures of which are incorporated by reference.

BACKGROUND OF THE INVENTION

1. Field of the Invention

The present invention relates to a high frequency low loss electrode for use in transmission lines and resonators operative in a microwave band and a millimeter wave band which are used mainly in radio communications, a transmission line, a high frequency resonator, a high frequency filter, an antenna sharing device, and communications equipment, each including the high frequency low loss electrode.

2. Description of the Related Art

Strip-type transmission lines and microstrip-type transmission lines, which can be easily produced and of which the size and weight can be reduced, are generally used in microwave IC's and monolithic microwave IC's operated at a high frequency. Resonators for such uses, in which the above-described lines have a length equal to a quarter-wavelength or a half-wavelength, or a circular resonator containing a circular conductor, are employed. The transmission loss of these lines and the unloaded Q of the resonators are determined mainly by the conductor loss. Accordingly, the performance of the microwave IC's and the monolithic microwave IC's depends on how much the conductor loss can be reduced.

These lines and resonators are formed with conductors with a high conductivity such as copper, gold, or the like. However, the conductivities of metals are inherent in the materials. There are limits to how much the loss can be reduced by selecting a metal with a high conductivity, and forming the metal into an electrode. Accordingly, great attention has been given to the fact that at the high frequency of a microwave or a millimeter wave, a current is concentrated at the surface of an electrode, due to the skin effect, and most of the loss occurs in the vicinity of the surface (hereinafter the "surface portion") of the conductor.

It has been attempted to reduce the conductor loss from the standpoint of the structure of the electrode. For example, in Japanese Unexamined Patent Publication 8-321706, a structure is disclosed in which plural linear conductors with a constant width are arranged in parallel to the propagation direction at constant intervals to reduce the conductor loss. Moreover, in Japanese Unexamined Patent Publication 10-13112, a structure is disclosed in which the surface portion of an electrode are divided into plural parts, so that a current concentrated at the surface portion is dispersed to reduce the conductor loss.

However, the method in which the whole of an electrode is divided into plural conductors having an equal width as disclosed in Japanese Unexamined Patent Publication 8-321706 has the problem that the effective cross-sectional area of the electrode is decreased, so that the conductor loss cannot be effectively reduced.

The method in which the surface portion of the electrode is divided into plural sub-conductors having substantially the same width, as disclosed in Japanese Unexamined Patent Publication 10-13112, is effective to some degree in relaxing the current concentration and reducing the conductor loss. However, for modern high-frequency communications applications, further improvement is needed.

SUMMARY OF THE INVENTION

Accordingly, it is an object of the invention to provide a high frequency low loss electrode having reduced conductor loss.

It is another object of the present invention to provide a transmission line, a high frequency resonator, a high frequency filter, an antenna sharing device, and communications equipment, each having a low loss due to the use of the above-described high frequency low loss electrode.

The present invention has been achieved based on a finding that in an electrode having an end portion divided into plural sub-conductors, the conductor loss can be effectively reduced by setting the widths of the sub-conductors according to a predetermined principle.

According to the present invention, there is provided a first high frequency low loss electrode which comprises a main conductor, and at least two sub-conductors formed along a side of the main conductor, the sub-conductors being formed so that a sub-conductor thereof positioned nearer to the outside has a smaller width.

Preferably, in the first high frequency low loss electrode of the present invention, the sub-conductor positioned nearest to the outside of said sub-conductors has a width smaller than ($\pi/2$) times the skin depth $\delta$ at an applied frequency. Consequently, an ineffective current flowing in the sub-conductor positioned nearest to the outside can be reduced. More preferably, to reduce the ineffective current flowing in the sub-conductor positioned nearest to the outside, the sub-conductor has a width smaller than ($\pi/4$) times the skin depth $\delta$ at an applied frequency.

Still more preferably, in the first high frequency low loss electrode of the present invention, to reduce ineffective currents flowing in all the sub-conductors, all the sub-conductors have a width smaller than ($\pi/2$) times the skin depth $\delta$ at an applied frequency.

More preferably, in the first high frequency low loss electrode of the present invention, the plural sub-conductors are formed so that a sub-conductor thereof positioned nearer to the outside is thinner, and thereby, the conductor loss can be reduced more effectively.

Moreover, in the first high frequency low loss electrode of the present invention, sub-dielectrics may be provided between the main conductor and the sub-conductor adjacent to the main conductor and between adjacent sub-conductors, respectively.

Also, preferably, in the first high frequency low loss electrode of the present invention, to cause currents to flow substantially in phase through the respective sub-conductors, the interval between the main conductor and the sub-conductor adjacent to the main conductor, and the intervals between adjacent sub-conductors, are formed so that an interval thereof positioned nearer to the outside is shorter, corresponding to the widths of the respective adjacent sub-conductors.

Still more preferably, in the first high frequency low loss electrode of the present invention, to cause currents to flow substantially in phase through the respective sub-conductors, the plural sub-dielectrics are formed so that a sub-dielectric thereof positioned nearer to the outside of the plural sub-dielectrics has a lower dielectric constant correspondingly to the widths of the respective adjacent sub-conductors.

Further, according to the present invention, there is provided a second high frequency low loss electrode which comprises a main conductor, and at least one sub-conductor formed along a side of the main conductor, said at least one sub-conductor having a width smaller than ($\pi/2$) times the skin depth $\delta$ at an applied frequency. Consequently, in a sub-conductor of which the width is set at a value smaller than ($\pi/2$) times the skin depth $\delta$ at an applied frequency, an ineffective current can be reduced, and the conductor loss can be effectively decreased.

More preferably, in the second high frequency low loss electrode of the present invention, said at least one sub-conductor has a width smaller than ($\pi/4$) times the skin depth $\delta$ at an applied frequency.

Still more preferably, in the second high frequency low loss electrode of the present invention, the sub-conductor positioned nearest to the outside of the sub-conductors, and advantageously all of the sub-conductors, have a width smaller than ($\pi/2$) times the skin depth $\delta$ at an applied frequency.

More preferably, in the second high frequency low loss electrode of the present invention, the sub-conductor positioned nearest to the outside of the sub-conductors, and advantageously all of the sub-conductors, have a width smaller than ($\pi/4$) times the skin depth $\delta$ at an applied frequency.

In the second high frequency low loss electrode of the present invention, sub-dielectrics may be provided between the main conductor and the sub-conductor adjacent to the main conductor and between adjacent sub-conductors, respectively.

Preferably, in the first and second high frequency low loss electrodes according to the present invention, the main conductor is a thin-film multi-layer electrode comprising thin-film conductors and thin-film dielectrics laminated alternately.

Still more preferably, in the first and second high frequency low loss electrodes according to the present invention, at least one of the main conductors and the sub-conductors is made of a superconductor.

A first high frequency resonator according to the present invention includes the above-described first or second high frequency low loss electrode.

A high frequency transmission line according to the present invention includes the above-described first or second high frequency low loss electrode.

A second high frequency resonator according to the present invention includes the above-described high frequency transmission line of which the length is set at a quarter-wavelength or a half-wavelength, multiplied by an integer.

Further, a high frequency filter according to the present invention includes the above-described first or second high frequency resonator.

Moreover, an antenna sharing device according to the present invention includes the above-described high frequency filter.

Further, a communications device according to the present invention includes the above-described high frequency filter or antenna sharing device.

Other features and advantages of the present invention will become apparent from the following description of embodiments of the invention which refers to the accompanying drawings.

DETAILED DESCRIPTION OF EMBODIMENTS OF THE INVENTION

Figure 1:
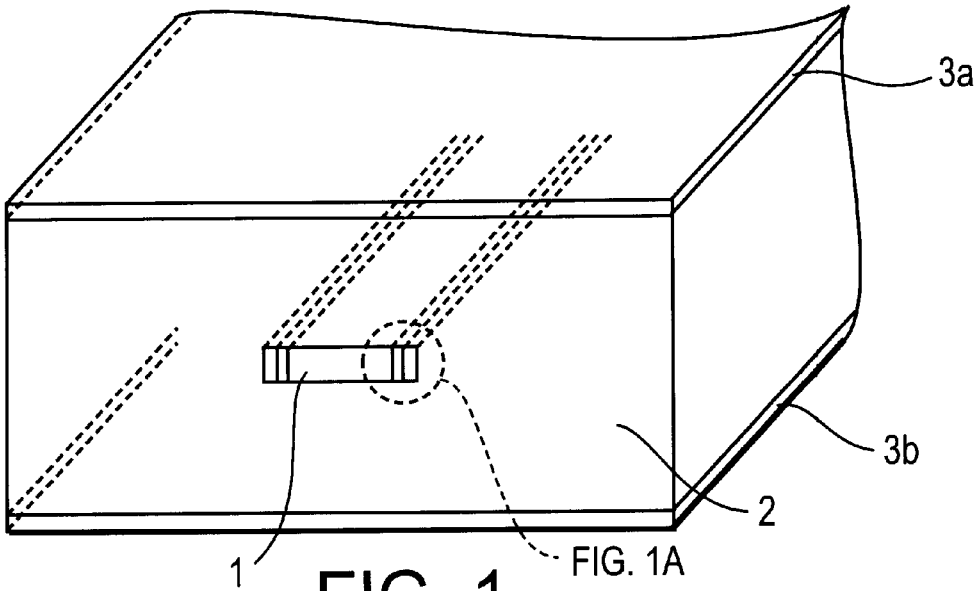
FIG. 1 is a triplet type strip line including a high frequency low loss electrode according to an embodiment of the present invention.
Figure 1A:
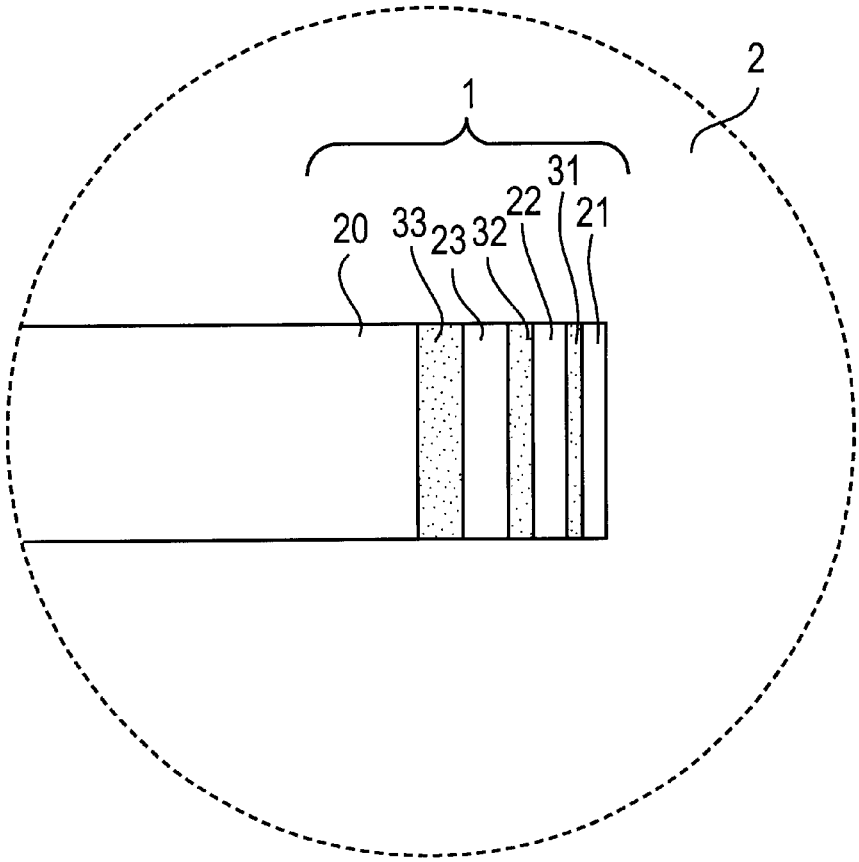

Hereinafter, a high frequency low loss electrode according to an embodiment of the present invention will be described. FIG. 1 shows a triplet type strip line including the high frequency low loss electrode 1 of this embodiment. The strip line has the configuration in which the high frequency low loss electrode 1 having a predetermined width is formed in the center of a dielectric 2 with a rectangular cross-section, and ground electrodes 3*a* and 3*b* are formed in parallel to the high frequency low loss electrode 1. In the high frequency low loss electrode 1 of this embodiment, as shown in the enlarged view of FIG. 1, the end portion is divided into sub-conductors 21, 22, and 23, so that a concentrated electric field in the end portion is dispersed, and the conductor loss at a high frequency is reduced. In the high frequency low loss electrode 1 of this embodiment, the sub-conductor 23 is attached adjacent to a main conductor 20 by a sub-dielectric 33. Further, a sub-dielectric 32, a sub-conductor 22, a sub-dielectric 31, and a sub-conductor 21 are formed sequentially toward the outside.

In particular, in the high frequency low loss electrode 1 of this embodiment, the sub-conductors 21, 22, and 23, and the sub-dielectrics 31, 32, and 33 are formed so that the widths of the sub-conductors and sub-dielectrics decrease with the distance from the main conductor 20, correspondingly. Further, the sub-conductors 21, 22, and 23 are formed to have a width which is up to $\pi/2$ times the skin depth $\delta$ at an applied frequency, and moreover, the widths of the sub-dielectrics 31, 32, and 33 are set so that currents flowing through the sub-conductors 21, 22, and 23 are substantially in phase. Accordingly, the loss of the high frequency low loss electrode 1 of this embodiment can be reduced as compared with a multi-line electrode, which is a conventional example, provided with sub-conductors having a substantially uniform width.

Hereinafter, the high frequency low loss electrode 1 of this embodiment will be described in detail, involving a method of setting the line width of the respective sub-conductors and the respective sub-dielectrics.

1. Current and Phase in Each Sub-Conductor (Currents and Phases Inside Respective Sub-conductors)

Figure 2:
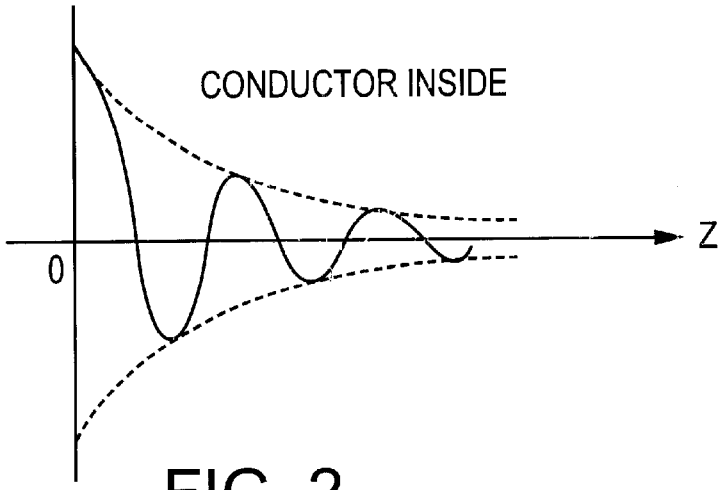
FIG. 2 is a graph showing the attenuation of a current density inside a conductor.

In general, the current density function J(z) inside a conductor is expressed by the following mathematical formula 1, caused by the skin effect which occurs at a high frequency. In the mathematical formula 1, z represents a distance in the depth direction from the surface taken as the reference (0), and $\delta$ represents the skin depth at an angular frequency $\omega(=2\pi f)$ which is expressed by the mathematical formula 2. Further, $\sigma$ represents a conductivity, and $\mu_0$ a permeability in vacuum. Accordingly, inside of the conductor, the current density is decreased at a position deeper from the surface as shown in FIG. 2.

$$J(z)=J_0 e^{-(1+j)z/\delta}(A/m^2) \quad \text{[mathematical formula 1]}$$

$$\delta=\sqrt{2/\omega\mu_{0\sigma}} \quad \text{[mathematical formula 2]}$$

Accordingly, the absolute value of the amplitude of the current density is expressed by the following mathematical formula 3, and is attenuated to 1/e at z=$\delta$. The phase of the amplitude of the current density is expressed by the mathematical formula 4. As z is increased (namely, at a position deeper from the surface), the phase is increased in the negative direction, and at z=δ (surface skin depth), the phase is decreased by 1 rad (about 60°) as compared with that at the surface.

$$abs(J(z))=|J_0|e^{-z/\delta} \quad \text{[mathematical formula 3]}$$

$$arg(J(z))=-z/\delta \quad \text{[mathematical formula 4]}$$

Accordingly, a power loss $P_{loss}$ is expressed by the following mathematical formula 5 using resistivity $\rho=1/\sigma$. The overall power loss $P^{o}_{loss}$ of a conductor which is sufficiently thick is expressed by the mathematical formula 6. At z=δ, $(1-e^{-2})$ of the overall power loss $P^{o}_{loss}$, namely, 86.5% is lost.

$$P_{loss} = \int_0^z \rho|J(z)|^2\,dz \ (\rho = 1/\sigma\text{: resistivity}) \quad \text{[mathematical formula 5]}$$
$$= \rho|J_0|^2\delta/2(1-e^{-2z/\delta})$$

$$P_{loss}^{0}=\rho|J_0|^2\delta/2 \quad \text{[mathematical formula 6]}$$

Further, by using the current density function J(z), the surface current K is given by the following mathematical formula 7. The surface current K is a physical quantity which is coincident with the tangential component of a magnetic field (hereinafter, referred to as a surface magnetic field) at the surface of a conductor. The surface current K is in phase with the surface magnetic field, and has the same dimension-as the surface magnetic field, namely, the dimension of A/m.

$$K = \int_0^\infty J(z)\,dz = \delta J/(1+j) \quad \text{[mathematical formula 7]}$$

Figure 3:
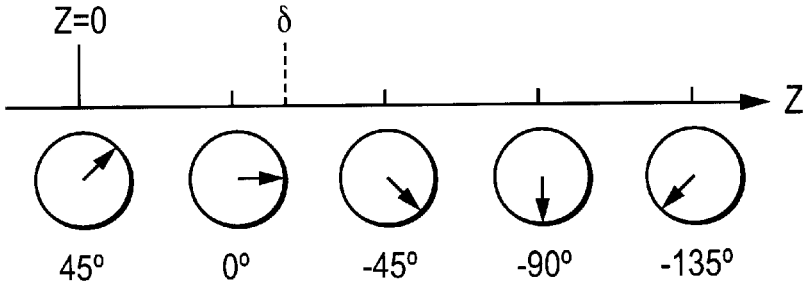
FIG. 3 illustrates the phase change of a current density inside a conductor.

As seen in the mathematical relation formula 7, the phase of the current density $J_o$ at the surface is 45°, if observed at the time when the phase of the surface current K (namely, the surface magnetic field) is 0°. Accordingly, the phase of the current density function J(z) inside the conductor can be illustrated by a model as shown in FIG. 3. Further, when the phase of the current density $J_0$ is 45°, the surface current K is given by the following mathematical formula 8.

$$\text{Assuming that } K=|K|=\delta|J_0|/\sqrt{2} \quad \text{[mathematical formula 8]}$$

the phase of the current density amplitude is not changed with the depth (it behaves like direct current), the surface current is expressed by the following mathematical formula 9.

$$K' = \int_0^\infty |J_0|e^{-2/\delta}\,dz \quad \text{[mathematical formula 9]}$$
$$= \delta|J_0|$$

As understood by the comparison of the mathematical formulae 8 and 9, the surface current K at a high frequency is decreased to be $1/\sqrt{2}$=70.7% as compared with the surface current K' of the direct current. It is speculated that this is because an ineffective current flows. In fact, it can be recognized that the overall power loss calculated based on the formula 9 can be expressed by the formula 5.

On the other hand, if the current density expressed by the formula 9 is multiplied by $1/\sqrt{2}$ so that the surface currents are equal to each other, the overall power loss, on the condition that the equal surface currents are realized, will be $(1/\sqrt{2})^2$=½=50%.

Accordingly, under the ideal limit condition that the phases of the current densities are made equal to 0°, and the phases suffer no changes inside the conductor, the power loss can be reduced to 50%. Practically, since the phase of the current density is decreased inside the conductor, it is difficult to realize the above-described ideal state.

(Current and Phase in Each Sub-conductor)

Figure 4:
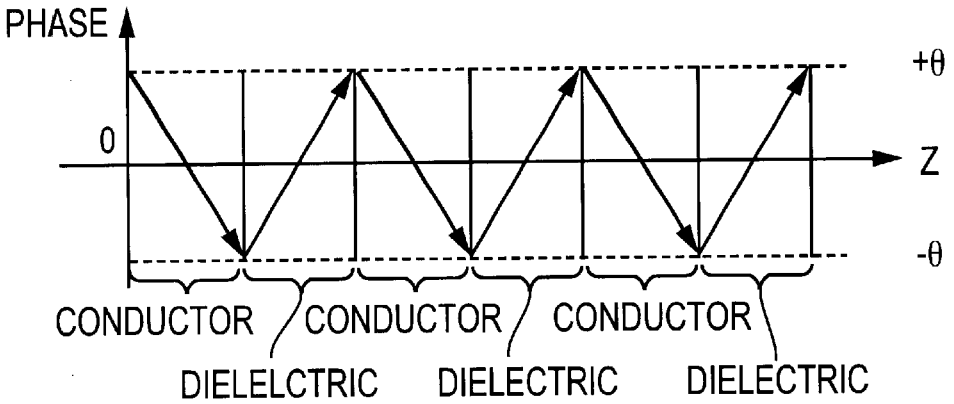
FIG. 4 illustrates the phase change of a current density when conductors and dielectrics are alternately arranged.

However, in the multi-line structure in which sub-conductors and sub-dielectrics are alternately arranged, the periodic structure in which the phase is changed periodically in the range of ±θ as shown in FIG. 4 can be realized by utilization of the phenomenon that the phase of a current density inside a dielectric increases. That is, characteristically, in the high frequency low loss electrode 1 of this embodiment, the structure is realized in which the phases of the current densities inside the sub-conductors are changed periodically in a relative small range with respect to the center of 0, by setting θ at a small value in the above-described periodic structure, and thereby, an ineffective current is reduced.

Accordingly, the following two points to be preferred and satisfied for the high frequency low loss electrode 1 of this embodiment can be derived from the above discussion.

(1) The line-width of each sub-conductor is set so that the change width (2θ) of the current density phase is small. As seen in the above description, the narrower the line-width of the sub-conductor, the more the change width of the phase can be reduced, to reach the above-described ideal state. Practically, in consideration of the manufacturing cost, the phase is set preferably at θ≦90°, and more preferably at θ≦45°.

The setting at θ≦90° can be achieved by setting the line width of each sub-conductor at πδ/2 or lower. Further, the setting at θ≦45° can be made by setting the line-width of each sub-conductor at πδ/4 or lower.

(2) The widths of the sub-dielectrics are set so that the changed current density phases in the respective sub-conductors lying on the current-approaching side are cancelled out.

2. Analysis of Multi-Line Structure by Equivalent Circuit

Hereinafter, the multi-line structure of the high frequency low loss electrode 1 of the present invention will be described in reference to a simplified modeled structure.

Figure 5A:
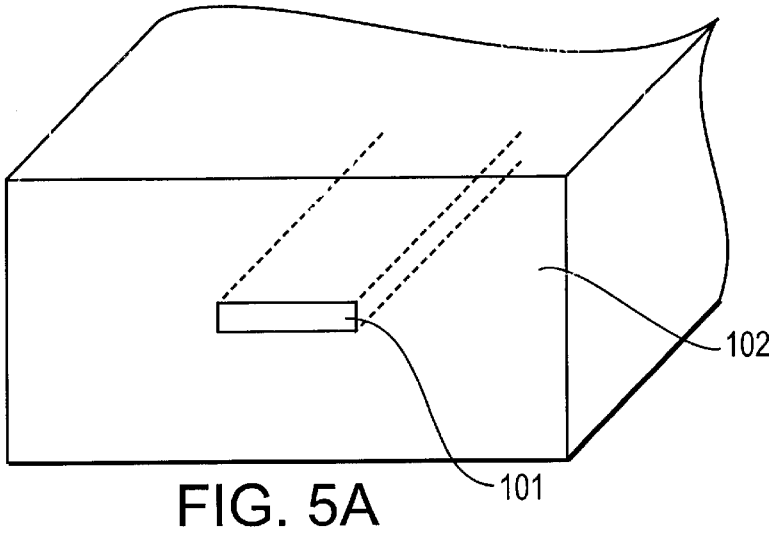
FIG. 5A is a perspective view of a triplet type strip line model for analysis of a multi-line structure electrode according to the present invention.
Figure 5B:
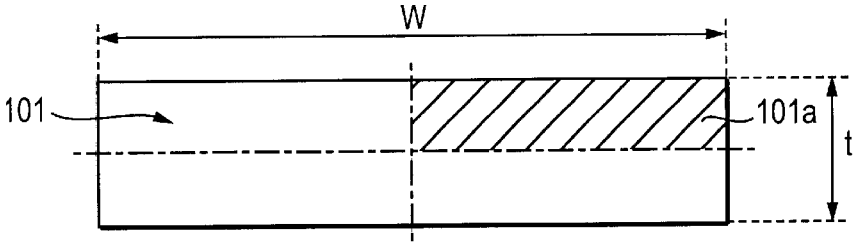
FIG. 5B is an enlarged cross-sectional view of the strip conductor in the model of FIG. 5A.
Figure 5C:
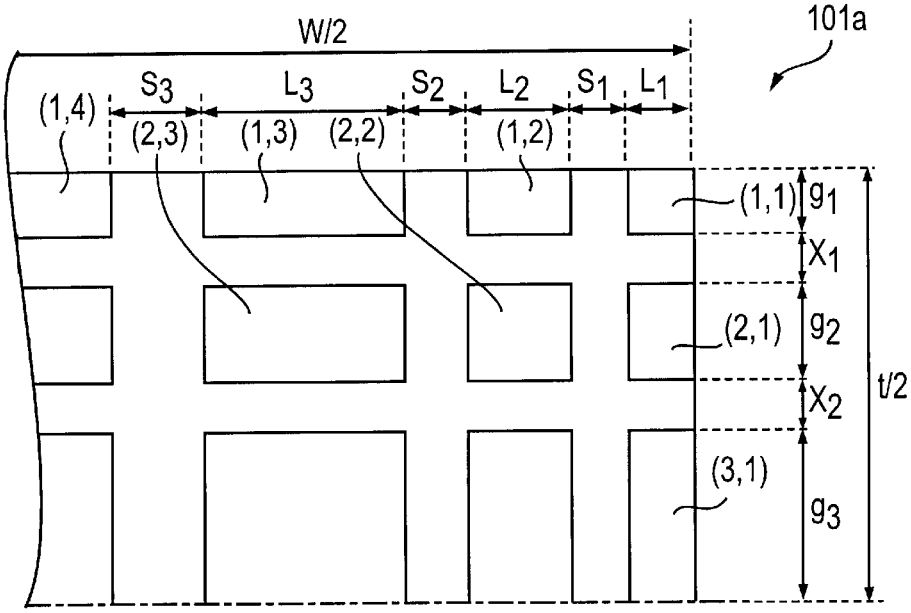
FIG. 5C is a further enlarged cross-sectional view of the strip conductor.

FIG. 5A shows a triplete type strip line model which can be analyzed relatively easily, and will be used in the following description. The model has the configuration in which a strip conductor 101 with a rectangular cross-section is provided in a dielectric 102. The strip conductor 101 is configured so that the cross-section is symmetric with respect to right and left and upper and lower sides as shown in FIG. 5B. Further, as shown in FIG. 5C, which is an enlarged view of part of the conductor segment 101*a* in FIG. 5B, the strip conductor 101 has the above-described multi-line structure in an end portion thereof, and is composed of multi-layers in the thickness direction. More particularly, the strip conductor 101 is composed of many sub-conductors, and has the matrix structure in which the sub-conductors (1, 1), (2, 1), (3, 1) . . . are arranged in the thickness direction, and the sub-conductors (1, 1), (1, 2), (1, 3) . . . are arranged in the width direction.

Figure 6:
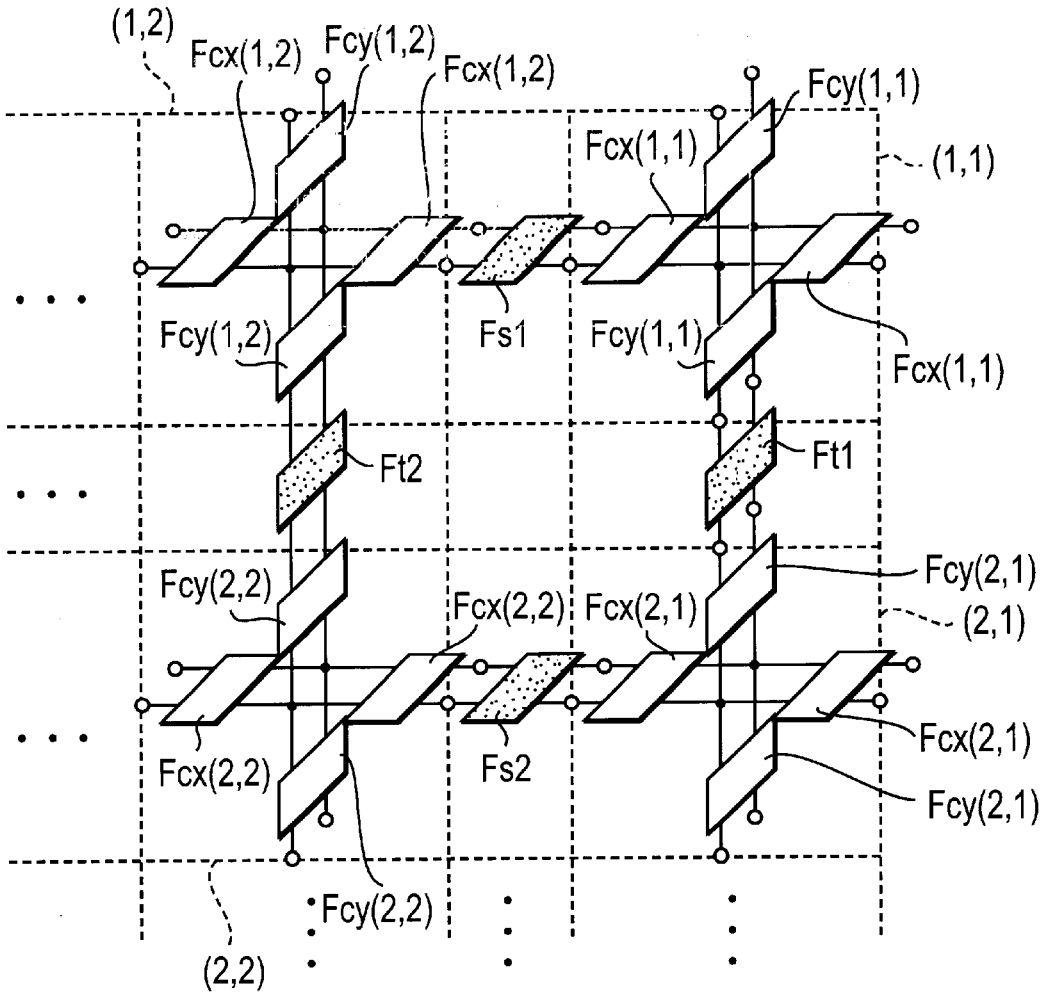
FIG. 6 is a two-dimensional equivalent circuit diagram of the multi-layer multi-line model of FIG. 5C.

The two-dimensional equivalent circuit as shown by the multi-layer multi-line model in FIG. 5C can be expressed as in FIG. 6. In FIG. 6, Fcx represents the cascade connection matrix of the conductors in the width direction thereof, and Fcy the cascade connection matrix of the conductors in the thickness direction thereof. The codes (1, 1), (1, 2) . . . , which correspond to the respective sub-lines, are appended to Fcx and Fcy.

The respective cascade connection matrices Fcx, Fcy, Ft, and Fs are expressed by the following formulae 10 through 13. Ft represents the cascade connection matrix of the dielectric layers in the respective lines. The dielectric layers are numbered sequentially from the uppermost layer. Fs represents the cascade connection matrix of the adjacent conductor lines in the width direction, and numbered sequentially from the outside. In the formulae 10 through 13, L and g represent the width and the thickness of each sub-conductor, and S the width of the sub-dielectric between adjacent sub-conductors. Accordingly, the cascade connection matrixes Fcx, Fcy, Ft, and Fs correspond to the widths and the thicknesses of the respective sub-conductors, and the widths of the respective sub-dielectrics. In this case, Zs represents the surface (characteristic) impedance of each conductor, and expressed by $Zs=(1+j)\sqrt{\{((\omega\mu_0)/(2\sigma)\}}$.

$$F_{cx} = \begin{pmatrix} \cosh\left(\frac{1+j}{\delta}\cdot\frac{L}{2}\right) & Zs\sinh\left(\frac{1+j}{\delta}\cdot\frac{L}{2}\right) \\ \frac{1}{Zs}\sinh\left(\frac{1+j}{\delta}\cdot\frac{L}{2}\right) & \cosh\left(\frac{1+j}{\delta}\cdot\frac{L}{2}\right) \end{pmatrix} \quad \text{[mathematical formula 10]}$$

$$F_{cy} = \begin{pmatrix} \cosh\left(\frac{1+j}{\delta}\cdot\frac{g}{2}\right) & Zs\sinh\left(\frac{1+j}{\delta}\cdot\frac{g}{2}\right) \\ \frac{1}{Zs}\sinh\left(\frac{1+j}{\delta}\cdot\frac{g}{2}\right) & \cosh\left(\frac{1+j}{\delta}\cdot\frac{g}{2}\right) \end{pmatrix} \quad \text{[mathematical formula 11]}$$

$$F_t = \begin{pmatrix} 1 & j\omega\mu_0 t\left(1-\frac{\varepsilon_m}{\varepsilon_t}\right) \\ 0 & 1 \end{pmatrix} \quad \text{[mathematical formula 12]}$$

$$F_s = \begin{pmatrix} 1 & j\omega\mu_0 S\left(1-\frac{\varepsilon_m}{\varepsilon_s}\right) \\ 0 & 1 \end{pmatrix} \quad \text{[mathematical formula 13]}$$

Accordingly, theoretically, the line width L and the thickness g of the respective sub-conductors, and the width S and the thickness t of the respective sub-dielectrics may be set so that the real part (resistance component) of the surface impedance of the respective sub-conductors is minimum, by operating the connection matrixes based on the two-dimensional equivalent circuit of FIG. 6.

However, it is difficult to determine analytically the line width L and the thickness g of the respective sub-conductors, and the width S and the thickness t of the respective sub-dielectrics based on the two-dimensional equivalent circuit of FIG. 6 and in the above-described conditions.

Figure 7:
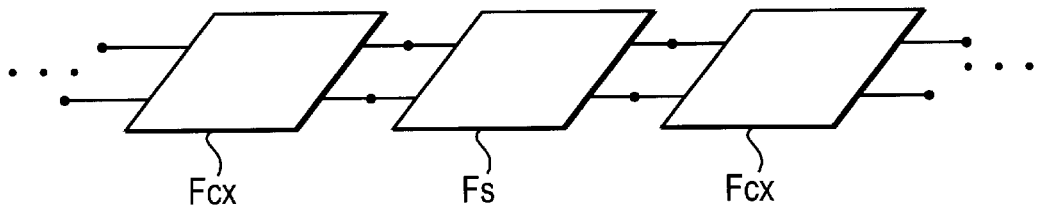
FIG. 7 is a one-dimensional equivalent circuit diagram in one direction of the multi-layer multi-line model of FIG. 5C and FIG. 6.

However, the inventors, by using the equivalent circuit of FIG. 7 which is the one-dimensional model in the width direction of the equivalent circuit of FIG. 6, have obtained the recurrence formula (mathematical formula 14) on the condition that the real part (resistance component) of the surface impedance of the respective sub-conductors is minimum. The line width L of the respective sub-conductors and the width S of the respective sub-dielectrics are set based on the parameter b satisfying the recurrence formula and the formulae 15 and 16. The equivalent circuit of FIG. 7 is the one-dimensional model in which the equivalent circuit of FIG. 6 is taken as a single layer, and the thickness direction of the single layer is not considered.

$$b_{k+1}=\tan h^{-1}(\tan b_k) \quad \text{[mathematical formula 14]}$$

$$L_{k+1}=L_k(b_{k+1}/b_k) \quad \text{[mathematical formula 15]}$$

$$S_{+1}=S_k(b_{k+1}/b_k) \quad \text{[mathematical formula 16]}$$

As described above, the line-width L of the respective sub-conductors and the width S of the respective sub-dielectrics were set, and the conductor loss at a high frequency was evaluated by a finite element method. It has been determined that the loss can be reduced as compared with the case where the line-width L of the respective sub-conductors and the width S of the respective sub-dielectrics are set at equal values, respectively. When the line-width L of the respective sub-conductors and the width S of the respective sub-dielectrics are set, it is necessary to give the initial values of b1, L1, and S1 previously. In this invention, it is preferable that the initial values are set so that the electric current phases of the respective current densities are in the range of ±90° or ±45°. As a result of the analysis using the one-dimensional model of FIG. 7, a satisfactory relationship is derived between L1 and SI to which initial values are to be given, in order to minimize the surface resistance. The initial values are given to L1 and S1 so as to satisfy the relationship, so that currents substantially in phase flow through the respective sub-conductors. That is, by the examination from the circuit theoretical standpoint, it is concluded that the preferable condition which the widths of the respective dielectrics are to satisfy is that the widths of the sub-dielectrics are set so that the changed current density phases in the sub-conductors on the current-approaching side are canceled out. Thus, the sane results as the conditions described above in "Current and Phase in Each Sub-conductor" can be obtained.

Further, by the inventors, the line-width L of the respective sub-conductors and the width S of the respective sub-dielectrics are set by using, instead of the formula 14, the following mathematical formulae 17 and 18 which are decreasing functions analogous to the recurrence formula of the mathematical formula 14. The conductor loss at a high frequency was evaluated by the finite element method. As a result, it has been determined that in the above-described manner, the loss can be reduced as compared with the case where the line-widths of the sub-conductors and also, the widths S of the sub-dielectrics are set at equal values, correspondingly.

$$b_{k+1}\tan h^{-1}b_k \quad \text{[mathematical formula 17]}$$

$$b_{k+1}=\tan b_k \quad \text{[mathematical formula 18]}$$

The results obtained by use of the respective formulae 14, 17, and 18 become different when the initial values are given differently. Thus, a skilled person can decide which formula is most appropriate, but the results are not always optimal.

That is, the recurrence formula of the formula 14 is determined by use of the one-dimensional model, and does not necessarily give an optimum result when it is applied to the two dimensional model. Practically, inside the sub-conductors, the width direction and the thickness direction are influenced by each other, so that the propagation vector includes angular information. However, the angular information is not considered by the equivalent circuit of FIG. 6. Accordingly, the formulae 14, 17, and 18 have no essential physical meanings, and play a role like a trial function in the two-dimensional model. Thus, after the effectiveness of the results obtained by use of these trial functions are confirmed by use of the finite element method, the final line-widths are set.

However, from the above-described circuit theoretical discussion, it follows that the overall conductor loss at a high frequency can be reduced by setting the width of a sub-line positioned nearer to the outside at a smaller value. Also, from the same discussion as described above, it follows that when the single layer, multi-line structure is employed, the overall conductor loss can be reduced by setting the thickness of a sub-line positioned nearer to the outside at a smaller value.

The widths of the sub-conductors and those of the sub-dielectrics are set based on the above-described principle. The results simulated by the finite element method will be described below.

Figure 8:
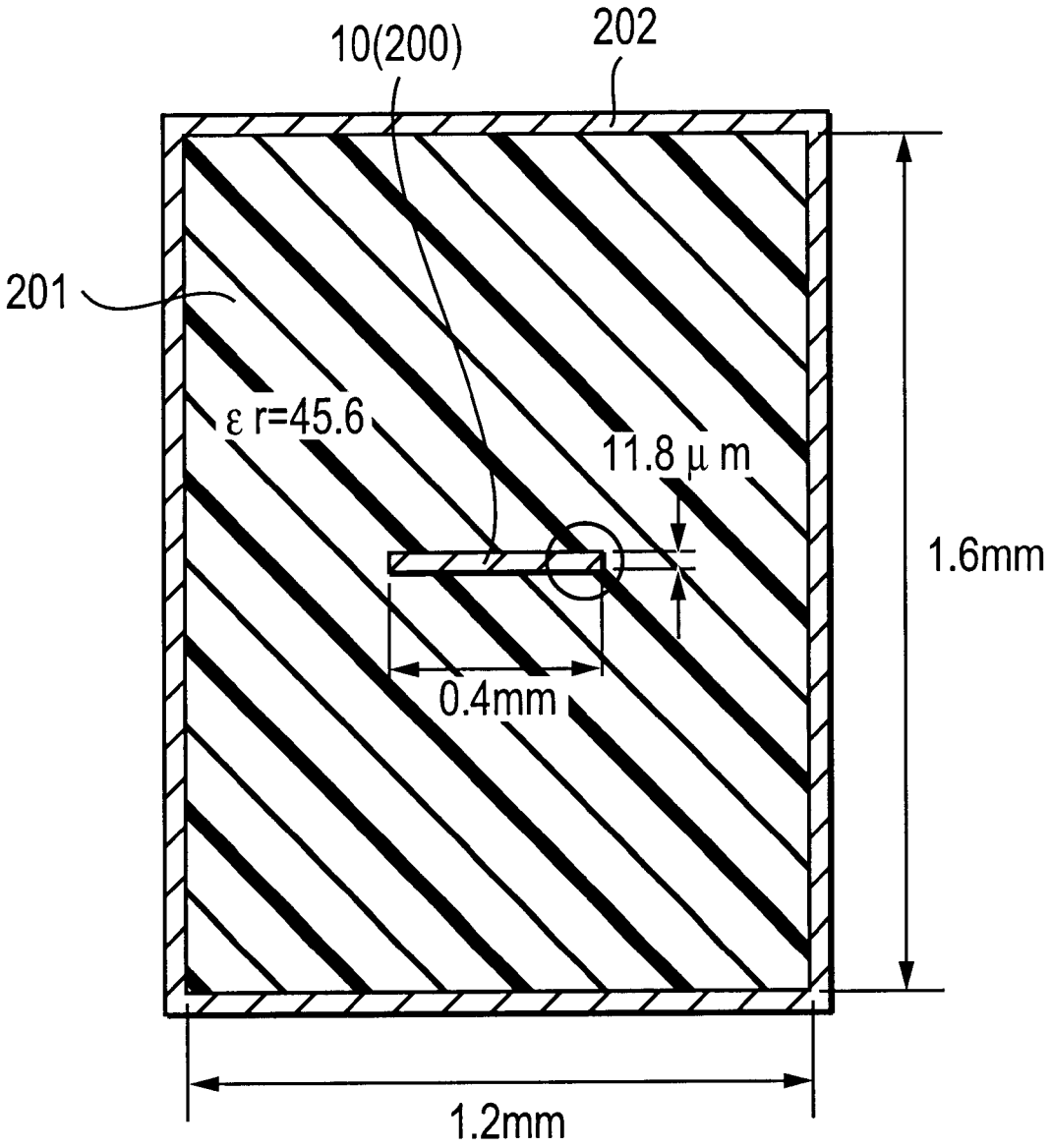
FIG. 8 is a perspective view of a triplet type strip line model used in the simulation of the multi-line structure electrode according to the present invention.

Each simulation described below was carried out by use of a model provided by filling a dielectric 201 with a relative dielectric constant of $\in r=45.6$ into the complete conductor cavity 202 as shown in FIG. 8, and disposing an electrode 10 or 200 in the center of the dielectric 201. The electrode 10 is that according to the present invention having a multi-line structure, while an electrode 200 is a conventional one, not having the multi-line structure.

Figure 9A:
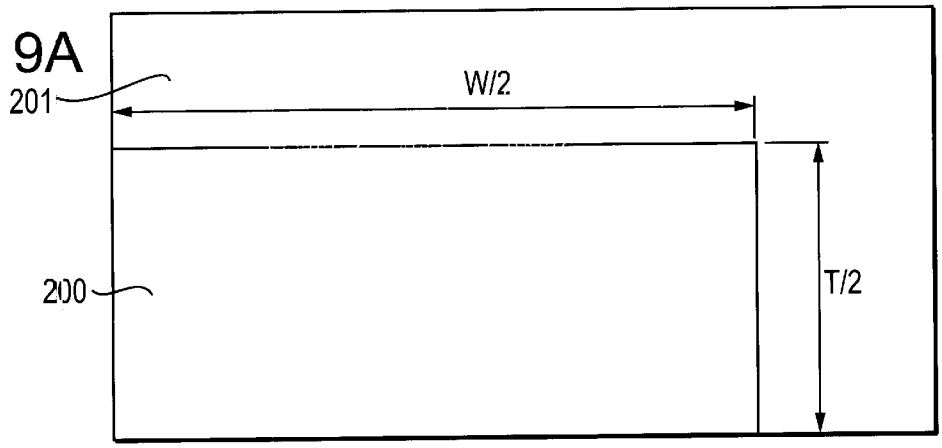
FIG. 9A is a view of a conventional electrode of which the structure is not the multi-line structure used in the simulation.
Figure 9B:
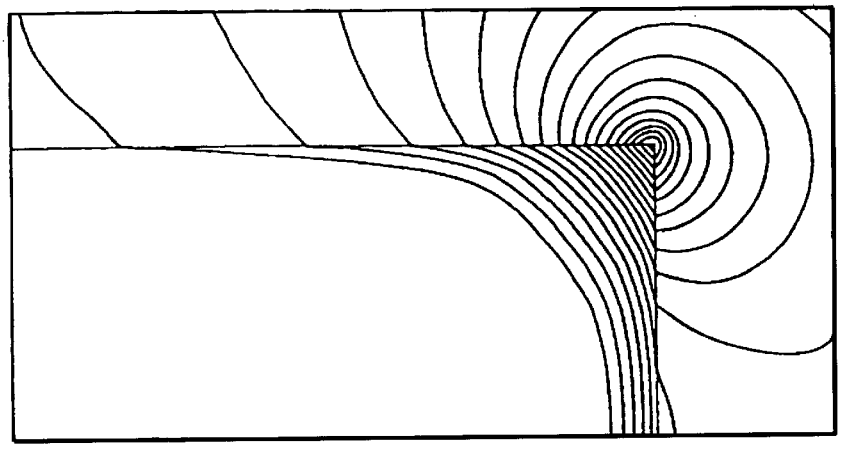
FIG. 9B illustrates the simulation results of the electric field distribution.
Figure 9C:
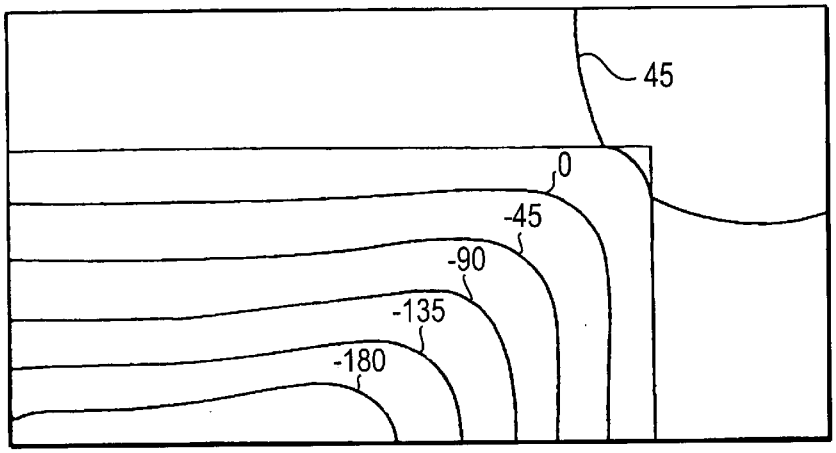
FIG. 9C illustrates the simulation results of the phase distribution.

FIG. 9 shows the electric field distribution and the phase of the electrode 200 as a conventional example not having the multi-line structure. The simulation was carried out by use of the model in which the cross-section is one fourth of that of the electrode 200 as shown in FIG. 9A. The overall width W of the electrode 200 was 400 mm, and the thickness T of the electrode 200 was 11.842 mm. As a result of the simulation, it is understood that the electric field is concentrated at the end of the electrode as shown in FIG. 9B, and the phase of the electric field is more decreased at a position further inside the electrode 200 as shown in FIG. 9C. The results of the simulation at 2 GHz are as follows.

(1) attenuation constant $\alpha$: 0.79179 Np/m, (2) phase constant $\beta$: 283.727 rad/m, (3) conductor Qc ($=\beta/2\alpha$); 179.129

Figure 10A:
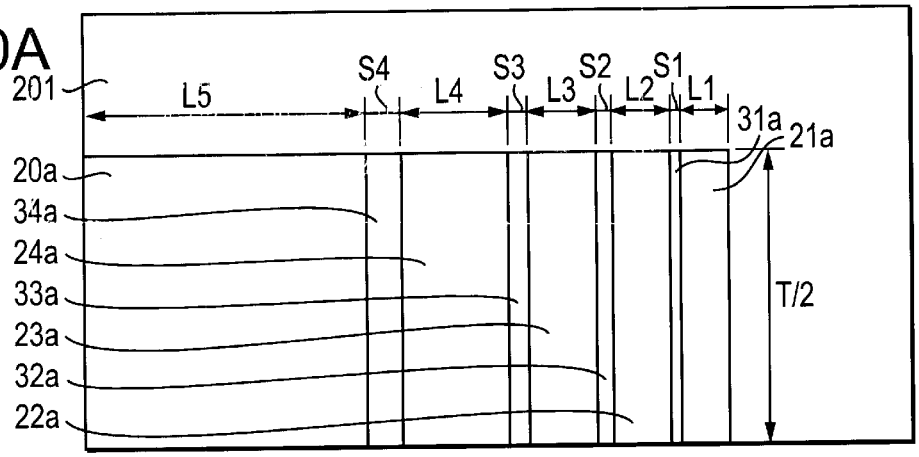
FIG. 10A illustrates the electrode of the present invention having a multi-line structure, used in the simulation.

As to the low loss electrode according to the present invention, having a multi-line structure, as shown in FIG. 10A, the results of the simulation at 2 GHz are as follows.

(1) attenuation constant $\alpha$: 0.63009 Np/m, (2) phase constant $\beta$: 283.566 rad/m, (3) conductor Qc ($=\beta/2\alpha$); 225.020

In this case, the conductor line-widths of the sub-conductors 21*a*, 22*a*, 23*a*, and 24*a* were L1=1.000 $\mu$m, L2=1.166 $\mu$m, L3=1.466 $\mu$m, and L4=2.405 $\mu$m, respectively.

The dielectric line-widths of the dielectrics 31*a*, 32*a*, 33*a*, and 34*a* were S1=0.3 $\mu$m, S2=0.35 $\mu$m, S3=0.44 $\mu$m, and S4=0.721 $\mu$m, correspondingly.

In the above simulation, calculation was carried out by use of the conductivity $\sigma$ of the conductors of 52.9 MS/m and the dielectric constant $\in_s$ of the dielectric lines of 10.0.

Figure 10B:
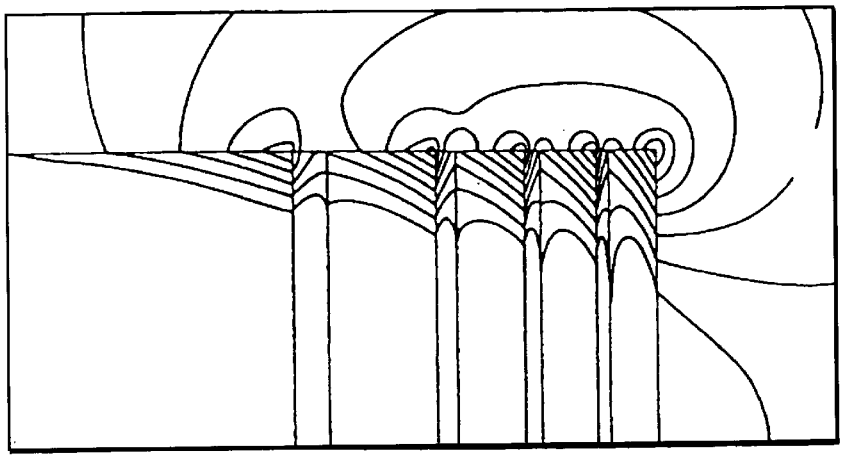
FIG. 10B illustrates the simulation results of an electric field distribution.
Figure 10C:
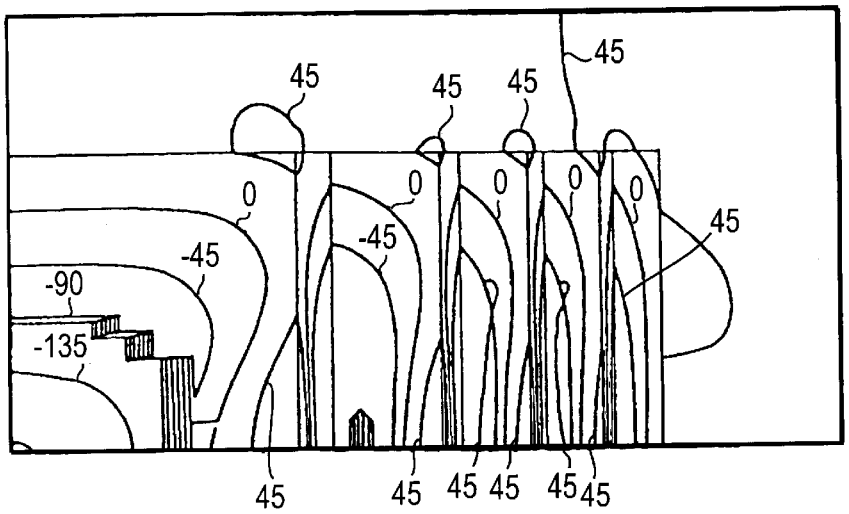
FIG. 10C illustrates the simulation results of the phase distribution.

It is understood that in the electrode of the present invention having a multi-line structure, the electric field is dispersed and distributed in the end portions of the respective sub-conductors and the main conductor 20*a* as shown in FIG. 10B. Further, as shown in FIG. 10C, the electric fields are distributed so that the phases of the electric fields in the respective sub-conductors are substantially in phase.

From the above-described discussion, the requirements which the high frequency low loss electrode 1 of this embodiment is to satisfy are as follows.

Requirements for Low Loss at High Frequency (i) The line-width of each sub-conductor is set so that the change-width ($2\theta$) of the current density phase is small. Concretely, preferably, the phase angle is set at $\theta \leqq 90°$, and more preferably, at $\theta \pm 45°$.

(ii) The sub-conductors are formed so that the width of a sub-conductor thereof positioned nearer to the outside is smaller.

(iii) The sub-conductors are formed so that the thickness of a sub-conductor thereof positioned nearer to the outside is smaller.

(iv) The widths of the sub-dielectrics are set so that the changed current density phases in the sub-conductors lying on the current-approaching side is cancelled out, respectively. That is, the widths of the sub-dielectrics are set so that the currents flowing in the respective sub-conductors are substantially in phase.

As seen in the above description, in the high frequency low loss electrode 1 of the present invention, the sub-conductors 21, 22, and 23, and also, the sub-dielectrics 31, 32, and 33 are so formed that a sub-conductor thereof and a sub-dielectric thereof lying at a position more distant from the main conductor 20 have a smaller width, correspondingly. The respective sub-conductors 21, 22, and 23 are formed to have a width which is up to $\pi/2$ times the skin depth $\delta$ at an applied frequency. Moreover, the widths of the respective sub-dielectrics 31, 32, and 33 are set so that the currents flowing in the respective sub-conductors 21, 22, and 23 are substantially in phase. Accordingly, in the high frequency low loss electrode 1 of this embodiment, the loss can be reduced as compared with a multi-line electrode as a conventional example provided with sub-conductors having substantially the same constant width, as described in detail later.

In the above embodiment, as a preferred form of the present invention, the high frequency low loss electrode 1 satisfying the requirements (i), (ii), and (iv) for reduction of the loss under the above-described high frequency condition is described. However, it is not necessary for all of these requirements to be satisfied at the same time. According to the present invention, a variety of modifications, each satisfying at least one of the above-described four requirements, are possible, including but not limited to those described below.

MODIFICATION EXAMPLE 1

Figure 11:
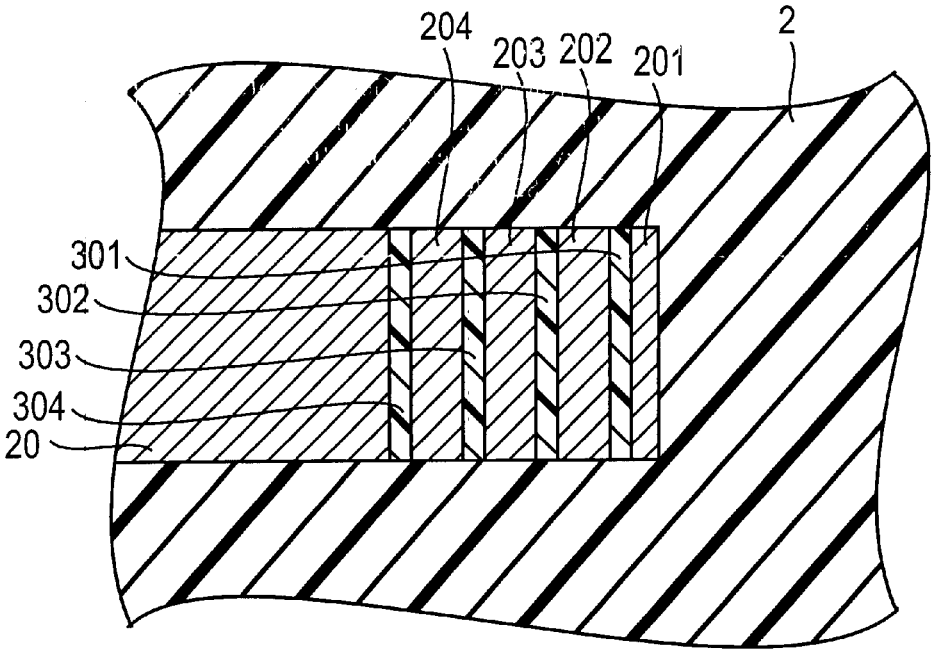
FIG. 11 is a cross-sectional view showing the configuration of a high frequency low loss electrode according to a modification example 1.

In the high frequency low loss electrode of the modification example 1, sub-conductors 201, 202, 203, and 204, and sub-dielectrics 301, 302, 303, and 304 are alternately disposed on an electrode end portion, as shown in FIG. 11. In the modification example 1, the sub-conductors 202, 203, and 204 have the same width, while the sub-conductor 201 has a width of up to $\pi\delta/2$. Preferably, its width is up to $\pi\delta/4$, and it is narrower than each of the sub-conductors 202, 203, and 204. Further, the sub-dielectrics 301, 302, 303, and 304 are formed to have substantially the same width. As described above, as compared with the conventional example, the conductor loss at a high frequency can be reduced by setting the width of the sub-conductor 201 positioned nearest to the outside in the plural sub-conductors at $\pi\delta/2$ or smaller.

In this modification example 1, more preferably, all the widths of the sub-conductors are set at $\pi\delta/2$ or smaller. More preferably, the line-width of the sub-conductor 201 is set at $\pi\delta/4$ or smaller, and the widths of the sub-conductors 202, 203, and 204 are set at $\pi\delta/2$ or smaller. Thus, in this modification example 1, the width of the sub-conductor 201 positioned nearest to the outside is set at a relatively small value. According to the present invention, at least one of the sub-conductors 202, 203, and 204 may also be narrow, that is, may have a width of up to $\pi\delta/2$, or more preferably, a width of up to $\pi\delta/4$.

MODIFICATION EXAMPLE 2

Figure 12:
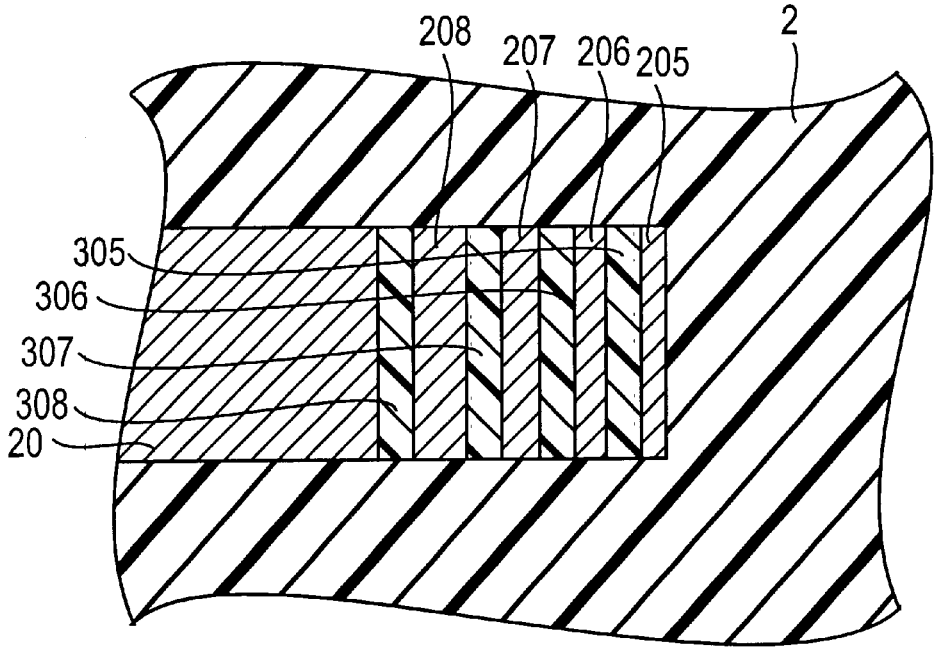
FIG. 12 is a cross-sectional view showing the configuration of a high frequency low loss electrode according to a modification example 2.

In the high frequency low loss electrode of the modification example 2, sub-conductors 205, 206, 207, and 208, and sub-dielectrics 305, 306, 307, and 308 are alternately disposed on an electrode end portion, as shown in FIG. 12. In this modification example 2, the widths of the sub-conductors 205, 206, 207, and 208 decrease toward the outside. The line-width of the sub-conductor 205 is set at $\pi\delta/2$ or smaller, preferably at $\pi\delta/4$ or smaller. Further, the sub-dielectrics 305, 306, 307, and 308 are formed to have substantially the same width. In the high frequency low loss electrode of the modification example 2 configured as described above, a sub-conductor positioned nearer to the outside has a smaller width, and the sub-conductor 205 positioned nearest to the outside at the outermost position has a width of $\pi\delta/2$ or smaller, or preferably $\pi\delta/4$ or smaller. Accordingly, the conductor loss can be reduced as compared with the conventional example.

MODIFICATION EXAMPLE 3

Figure 13:
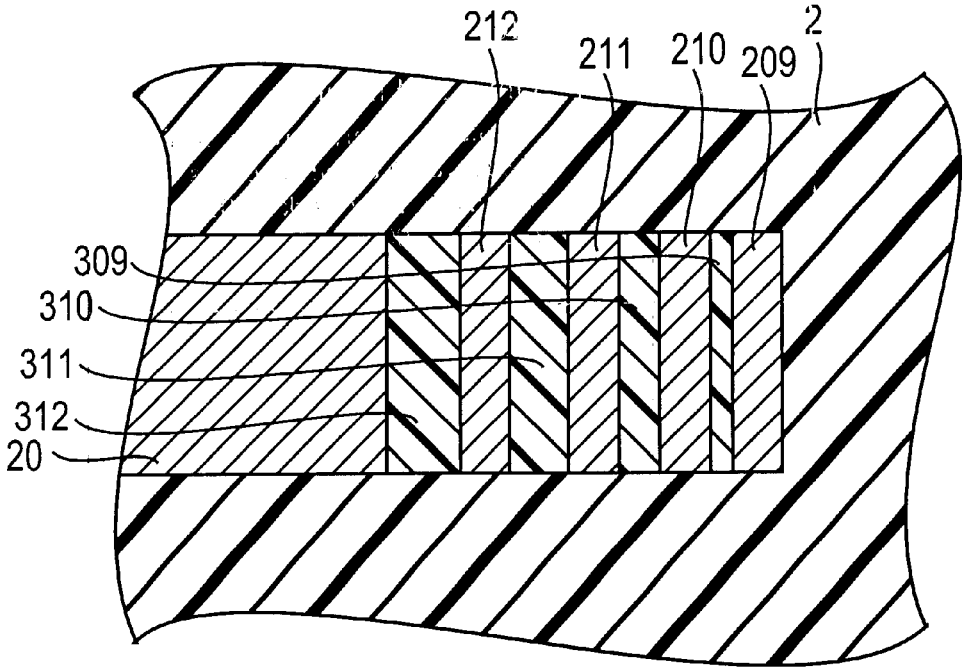
FIG. 13 is a cross-sectional view showing the configuration of a high frequency low loss electrode according to a modification example 3.

In the high frequency low loss electrode of the modification example 3, sub-conductors 209, 210, 211, and 212, and sub-dielectrics 309, 310, 311, and 312 are alternately disposed on an electrode end portion, as shown in FIG. 13. In this modification example 3, the widths of the sub-conductors 209, 210, 211, and 212 are substantially the same. The sub-dielectrics 309, 310, 311, and 312 are formed so that a sub-dielectric thereof positioned nearer to the outside has a smaller width. With the above-described configuration, the conductor loss at a high frequency can be reduced as compared with the conventional example.

In the high frequency low loss electrode of the modification example 3, preferably, the widths of the respective sub-conductors are $\pi\delta/2$ or smaller, or more preferably, $\pi\delta/4$ or smaller.

MODIFICATION EXAMPLE 4

Figure 14:
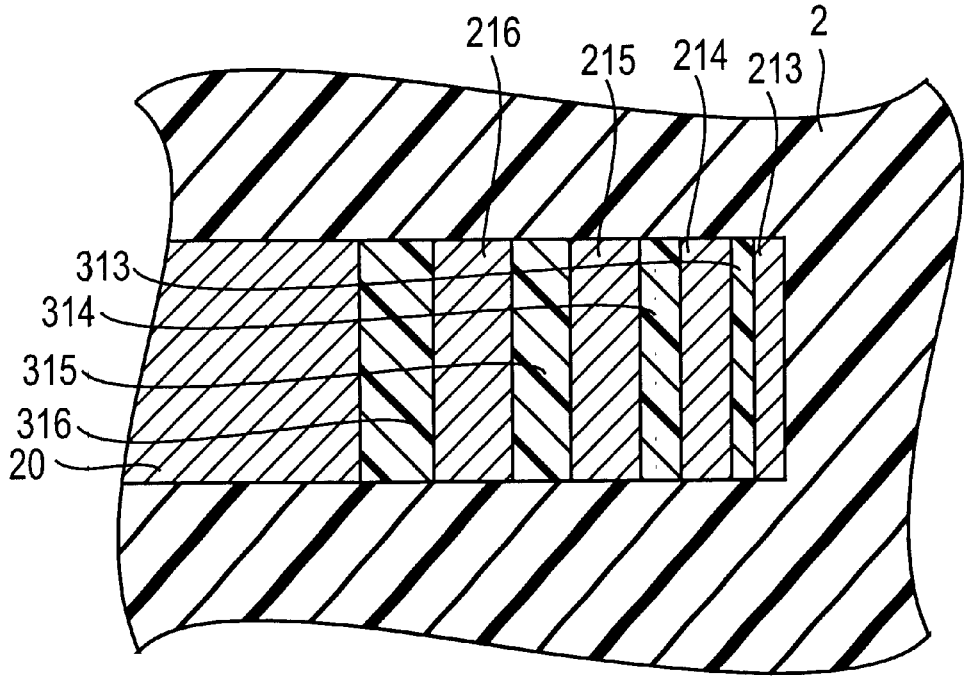
FIG. 14 is a cross-sectional view showing the configuration of a high frequency low loss electrode according to a modification example 4.

In the high frequency low loss electrode of the modification example 4, sub-conductors 213, 214, 215, and 216, and sub-dielectrics 313, 314, 315, and 316 are alternately disposed on an electrode end portion, as shown in FIG. 14. In this modification example 4, the sub-conductors 213, 214, 215, and 216, and the sub-dielectrics 313, 314, 315, and 316 are formed so that the widths of both the sub-conductors thereof and the sub-dielectrics thereof decrease toward the outside.

In the high frequency low loss electrode of the modification example 4 configured as described above, the surface resistance in the end portion can be reduced, and thereby, the conductor loss at a high frequency can be reduced as compared with the conventional example.

In this modification example 4, the line-widths of the respective sub-conductors are set preferably at $\pi\delta/2$ or smaller, and more preferably at $\pi\delta/4$ or smaller, and thereby, the ineffective currents in the respective sub-conductors can be decreased.

MODIFICATION EXAMPLE 5

Figure 15:
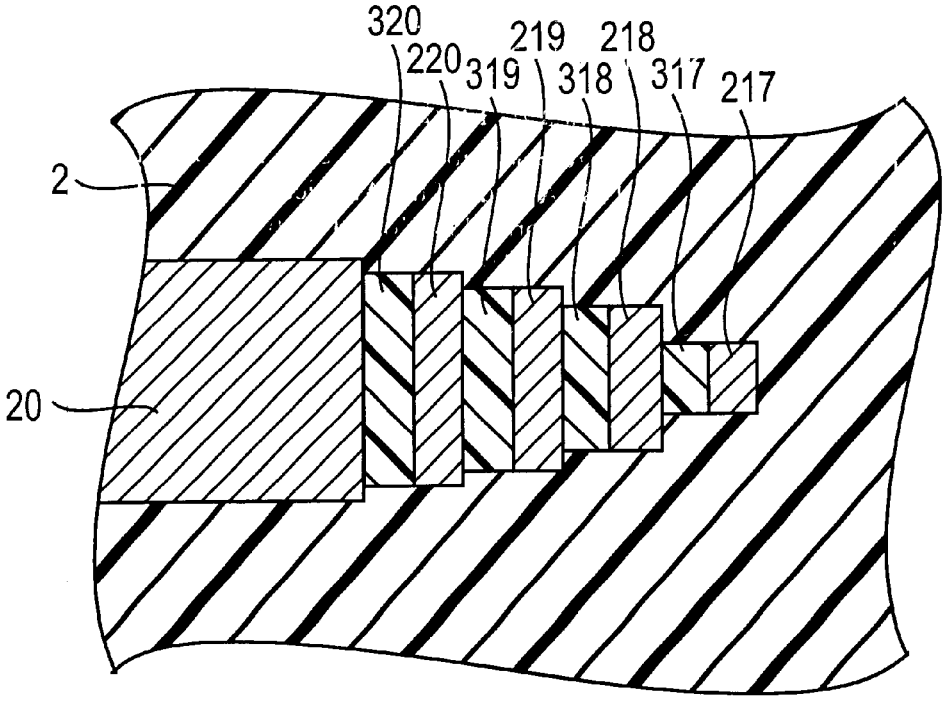
FIG. 15 is a cross-sectional view showing the configuration of a high frequency low loss electrode according to a modification example 5.

In the high frequency low loss electrode of the modification example 5, sub-conductors 217, 218, 219, and 220, and sub-dielectrics 317, 318, 319, and 320 are alternately disposed on an electrode end portion, as shown in FIG. 15. In the modification example 5, the sub-conductors 217, 218, 219, and 220 are formed so that a sub-conductor thereof positioned nearer to the outside has a smaller thickness (i.e., the vertical dimension as seen in FIG. 15), and also, the sub-dielectrics 317, 318, 319, and 320 are formed so that a sub-dielectric thereof positioned nearer to the outside has a smaller thickness. The sub-conductors 217, 218, 219, and 220 are set at substantially the same width, and the line widths are set at $\pi\delta/2$ or smaller, preferably at $\pi\delta/4$ or smaller. In the high frequency low loss electrode of the modification example 5 configured as described above, a current can be effectively dispersed into the respective sub-conductors, and the conductor loss at a high frequency can be reduced as compared with the conventional example.

MODIFICATION EXAMPLE 6

Figure 16:
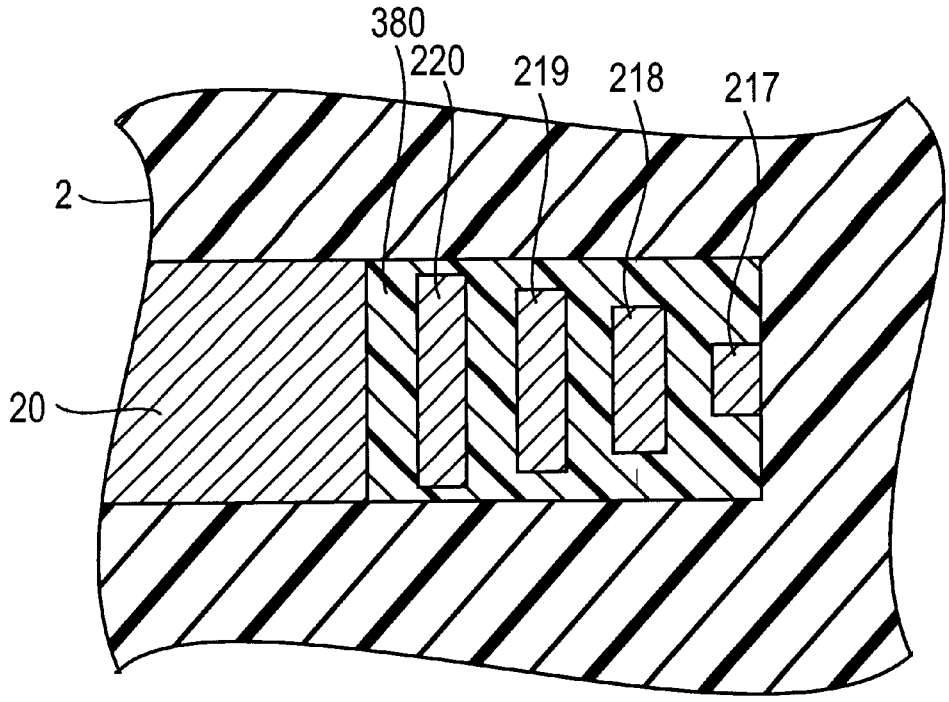
FIG. 16 is a cross-sectional view showing the configuration of a high frequency low loss electrode according to a modification example 6.

FIG. 16 is a cross-sectional view showing the configuration of the high frequency low loss electrode of the modification example 6. This high frequency low loss electrode has the same configuration as the high frequency low loss electrode of the modification example 5 except that a sub-dielectric 380 having the sub-dielectrics adjacent to the sub-conductors 217, 218, 219 and 220 integrated together is used instead of the separate sub-dielectrics 317, 318, 319, and 320 in the high frequency low loss electrode of the modification example 5.

The high frequency low loss electrode of the modification example 6 configured as described above has similar effects to those of the modification example 5.

MODIFICATION EXAMPLE 7

Figure 17:
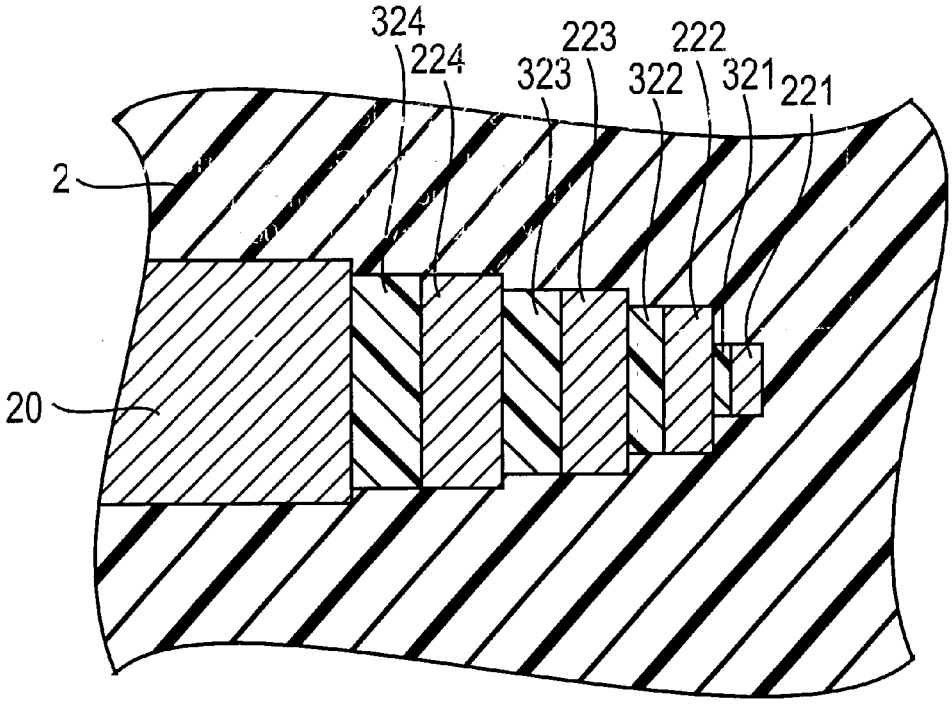
FIG. 17 is a cross-sectional view showing the configuration of a high frequency low loss electrode according to a modification example 7.

In the high frequency low loss electrode of the modification example 7, sub-conductors 221, 222, 223, and 224, and sub-dielectrics 321, 322, 323, and 324 are alternately disposed on an electrode end portion, as shown in FIG. 17. In the modification example 7, the sub-conductors 221, 222, 223, and 224 are formed so that a sub-conductor thereof positioned nearer to the outside has a smaller width and a smaller thickness, and the sub-dielectrics 321, 322, 323, and 324 are formed so that a sub-dielectric thereof positioned nearer to the outside has a smaller width and a smaller thickness. Preferably, the line-widths of the sub-conductors 221, 222, 223, and 224 are set at $\pi\delta/2$ or smaller, more preferably at $\pi\delta/4$ or smaller. In the high frequency low loss electrode of the modification example 7 configured as described above, a current can be effectively dispersed into the respective sub-conductors, and the conductor loss at a high frequency can be reduced as compared with the conventional example.

MODIFICATION EXAMPLE 8

Figure 18:
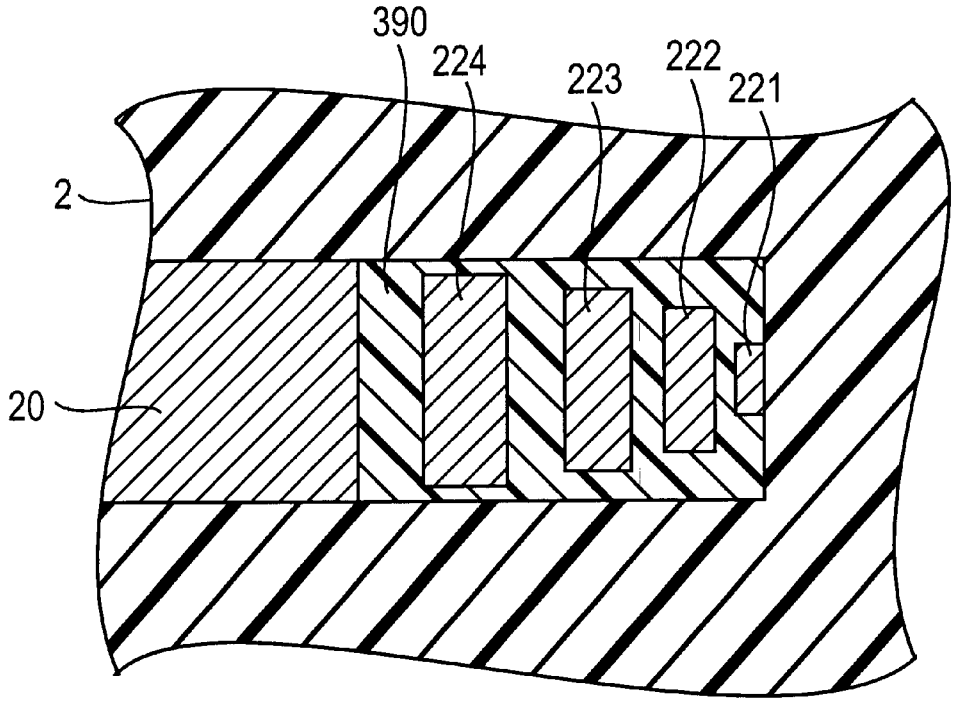
FIG. 18 is a cross-sectional view showing the configuration of a high frequency low loss electrode according to a modification example 8.

FIG. 18 is a cross-sectional view showing the configuration of the high frequency low loss electrode of the modification example 8. This high frequency low loss electrode has the same configuration as that of the modification example 7 except that a sub-dielectric 390 including the sub-dielectrics adjacent to the sub-conductors 221, 222, 223 and 224 integrated together is used instead of the separate sub-dielectrics 321, 322, 323, and 324 in the high frequency low loss electrode of the modification example 7.

The high frequency low loss electrode of the modification example 8 configured as described above has similar effects to those of the modification example 7.

MODIFICATION EXAMPLE 9

Figure 19:
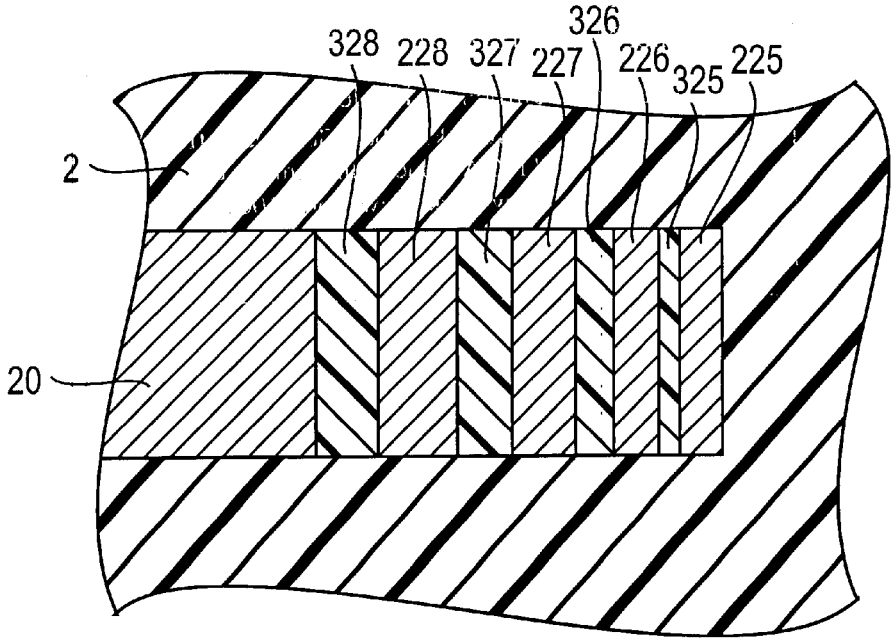
FIG. 19 is a cross-sectional view showing the configuration of a high frequency low loss electrode according to a modification example 9.

In the high frequency low loss electrode of the modification example 9, sub-conductors 225, 226, 227, and 228, and sub-dielectrics 325, 326, 327, and 328 are alternately disposed on an electrode end portion, as shown in FIG. 19. In the modification example 9, the sub-conductors 225, 226, 227, and 228, and the sub-dielectrics 325, 326, 327, and 328 are formed so that the widths of the sub-conductors and the sub-dielectrics decrease toward the outside. In the modification example 9, characteristically, the sub-dielectrics 325, 326, 327, and 328 are made of a material having a lower dielectric constant than the material of a dielectric 2 surrounding the sub-dielectrics 325, 326, 327, and 328.

In the high frequency low loss electrode of the modification example 9 configured as described above, the ineffective current flowing in the end portion of the electrode can be more reduced.

MODIFICATION EXAMPLE 10

Figure 20:
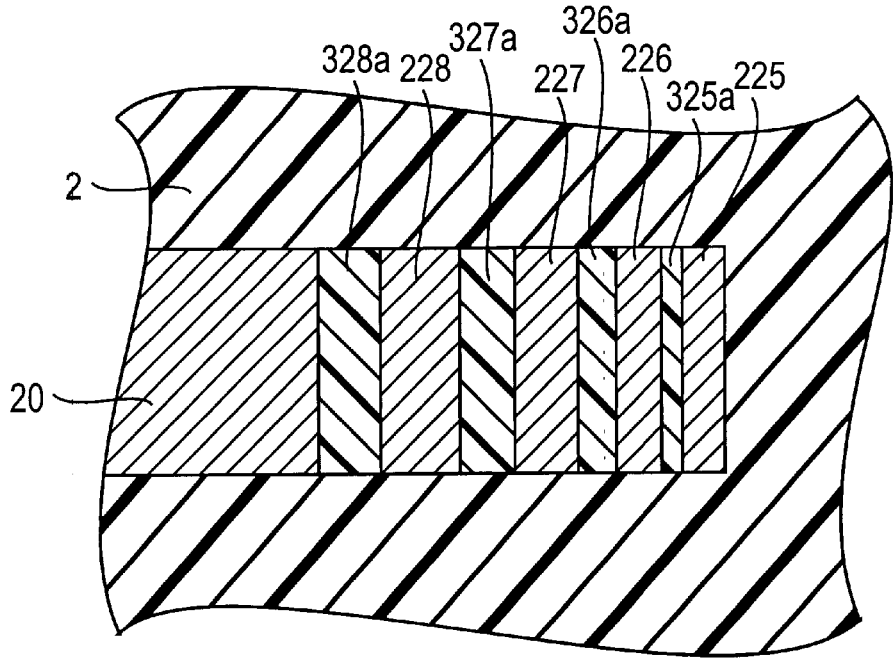
FIG. 20 is a cross-sectional view showing the configuration of a high frequency low loss electrode according to a modification example 10.

The high frequency low loss electrode of the modification example 10, as shown in FIG. 20, has the same configuration as the high frequency low loss electrode of the modification example 9 except that sub-dielectrics 325*a*, 326*a*, 327*a*, and 328*a* are used instead of the sub-dielectrics 325, 326, 327, and 328 of the high frequency low loss electrode of the modification example 9. Characteristically, the sub-dielectrics 325*a*, 326*a*, 327*a*, and 328*a* are all formed with a material with a lower dielectric constant than the dielectric 2 surrounding the sub-dielectrics 325*a*, 326*a*, 327*a*, and 328*a*, and moreover, the respective dielectric constants of the sub-dielectrics 325*a*, 326*a*, 327*a* and 328*a* increase toward the outside (to the right in FIG. 20).

In the high frequency low loss electrode of the modification example 10 configured as described above, the electric field intensity in the sub-dielectrics positioned nearest to the outside can be inhibited from increasing, and the power durability at a high power can be enhanced.

MODIFICATION EXAMPLE 11

Figure 21:
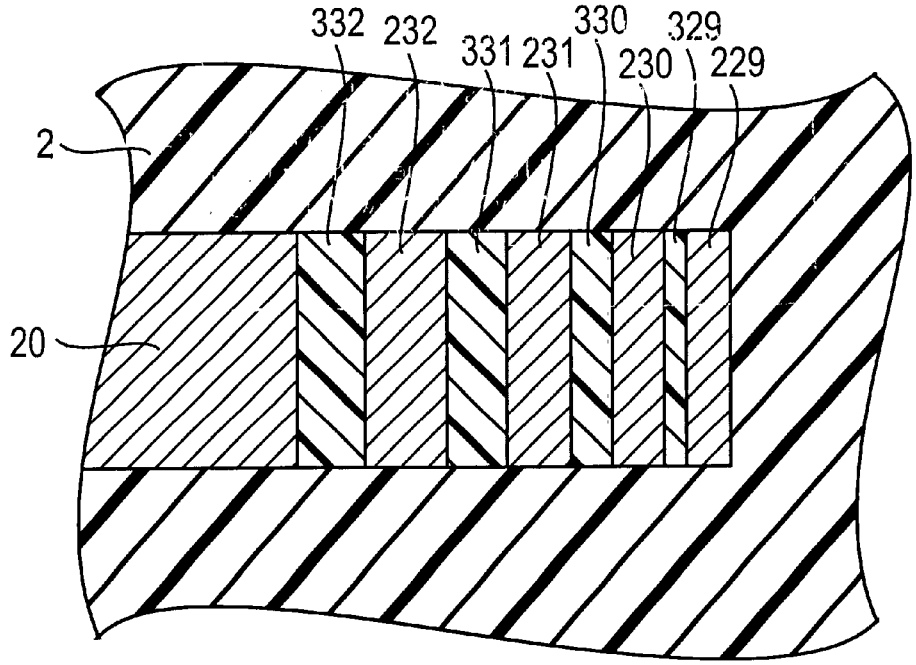
FIG. 21 is a cross-sectional view showing the configuration of a high frequency low loss electrode according to a modification example 11.
Figure 22:
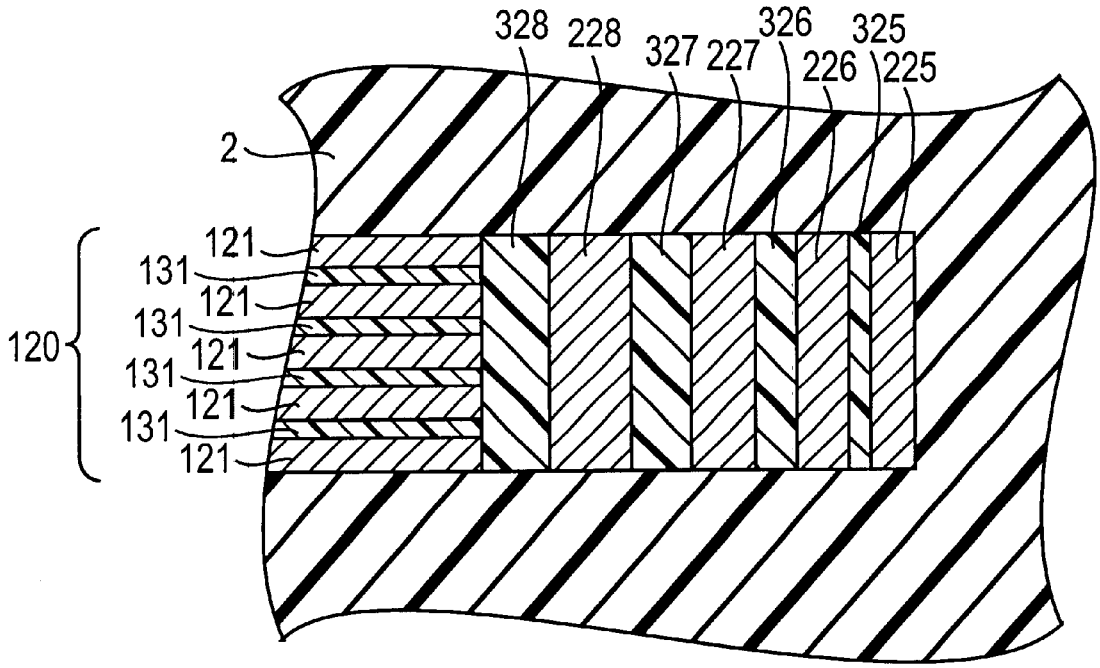
FIG. 22 is a cross-sectional view showing the configuration of a high frequency low loss electrode according to a modification example 12.

In a high frequency low loss electrode as a modification example 11, sub-conductors 229, 230, 231, and 232, and sub-dielectrics 329, 330, 331, and 332 are alternately disposed on the electrode end portion, as shown in FIG. 21. In the modification example 11, the sub-conductors 229, 230, 231, and 232, and the sub-dielectrics 329, 330, 331, and 332 are formed so that a sub-conductor thereof and a sub-dielectric thereof positioned nearer to the outside have a smaller width, correspondingly. Further, characteristically, in the modification example 11, the conductivities of the sub-conductors 229, 230, 231, and 232 are different from each other, decreasing toward the outside, and further are lower than the conductivity of the main conductor. Optionally, the sub-conductors 229, 230, 231 and 232, or some of these, may have the same conductivity, as long as the conductivities are less than that of the main conductor 20.

In the high frequency low loss electrode of the modification example 11 configured as described above, the widths of the sub-conductors 229, 230, 231, and 232 can be increased by forming the sub-conductors 229, 230, 231, and 232 with conductors having a lower conductivity than the main conductor. This facilitates the production of the high frequency low loss electrode.

MODIFICATION EXAMPLE 12

The high frequency low loss electrode of the modification example 12 is the same as that of the modification example 9 except that a thin-film multi-layer electrode 120 composed of thin-film conductors 121 and thin-film dielectrics 131 laminated alternately is used instead of the main conductor 20 in the high frequency low loss electrode of the modification example 9. With this configuration, the skin effect in the main conductor 120 can be relaxed. Therefore, the conductor loss in the main conductor 120 can be reduced. Further, the loss at a high frequency can be decreased.

In addition, in the modification example 12, a main conductor made of a superconductor may be employed instead of the main conductor 120 made of the thin-film multi-layer electrode. With the above configuration, the current density in the end portion of the main conductor made of the superconductor can be reduced. Thus, the end portion of the main conductor can be made to act at the critical current density or lower.

As described above, the high frequency low loss electrode of the present invention having different configurations can be realized. The above embodiments and the modification examples are described in the case of three or four sub-conductors, as an example. Needless to say, the present invention is not limited to the three or four sub-conductors. For the configuration, fifty through one hundred or more sub-conductors may be used. The loss can be reduced more effectively by increasing the number of the sub-conductors and shortening the widths of the sub-conductors.

The high frequency low loss electrode of the present invention can be applied for various devices by utilizing the low loss characteristics. Hereinafter, application examples of the present invention will be described.

APPLICATION EXAMPLE 1

Figure 23B:
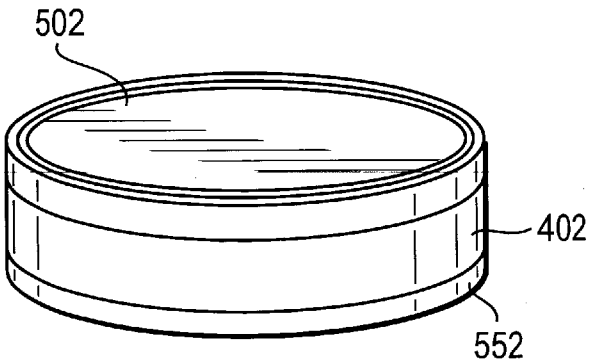
FIG. 23B is a perspective view showing the configuration of a circular resonator as an application example 2 of the high frequency low loss electrode according to the present invention.
Figure 23D:
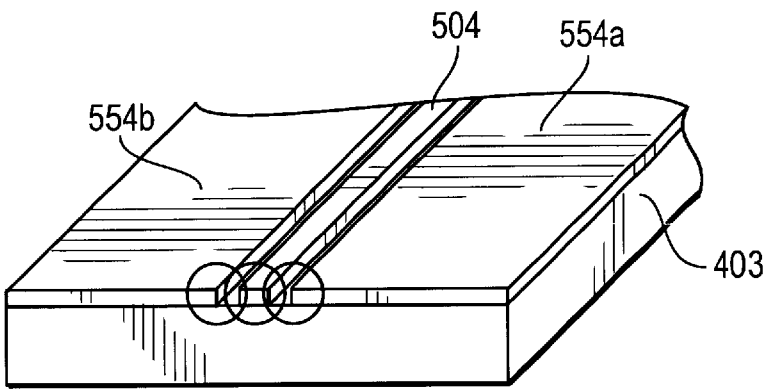
FIG. 23D is a perspective view showing the configuration of a coplanar line as an application example 4 of the high frequency low loss electrode according to the present invention.
Figure 23A:
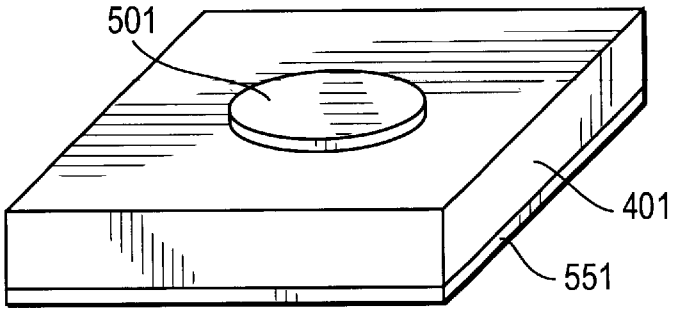
FIG. 23A is a perspective view showing the configuration of a circular strip resonator as an application example 1 of the high frequency low loss electrode according to the present invention.

FIG. 23A is a perspective view showing the configuration of a circular strip resonator of the application example 1. The circular strip resonator comprises a rectangular dielectric substrate 401, a ground conductor 551 formed on the lower surface of the dielectric substrate 401, and a circular conductor 501 formed on the upper surface of the substrate 401. In this circular strip resonator, the circular conductor 501 is made of the high frequency low loss electrode of the present invention which has at least one sub-conductor running around its periphery, and thereby, the conductor loss in the peripheral portion can be reduced as compared with a conventional circular conductor having no sub-conductors. Consequently, in the circular strip resonator of the application example 1 of FIG. 23 A, the unloaded Q can be increased as compared with the conventional circular strip resonator.

APPLICATION EXAMPLE 2

FIG. 23B is a perspective view showing the configuration of a circular resonator of the application example 2. The circular resonator comprises a rectangular dielectric substrate 402, a ground conductor 552 formed on the lower surface of the circular dielectric substrate 402, and a circular conductor 502 formed on the upper surface of the circular substrate 402. In this circular strip resonator, the circular conductor 502 is made of the high frequency low loss electrode of the present invention which has at least one sub-conductor at the periphery. The conductor loss in the peripheral portion can be reduced as compared with a conventional circular conductor having no sub-conductors. Consequently, in the circular resonator of the application example 2 of FIG. 23B, the unloaded Q can be increased as compared with the conventional circular resonator. In the circular resonator of this application example 2, the ground conductor 552 may also be made of the high frequency low loss electrode of the present invention. With this configuration, the unloaded Q can be further enhanced.

APPLICATION EXAMPLE 3

Figure 23C:
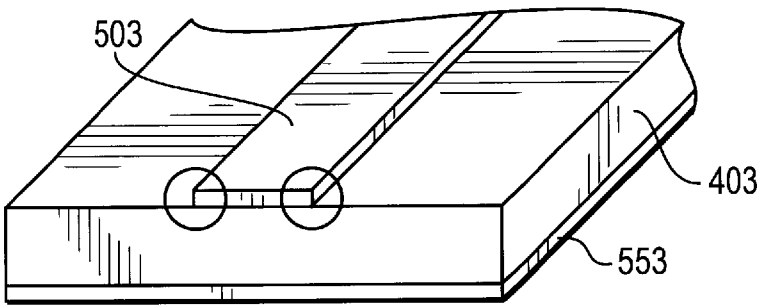
FIG. 23C is a perspective view showing the configuration of a microstrip line as an application example 3 of the high frequency low loss electrode according to the present invention.

FIG. 23C is a perspective view showing the configuration of a microstrip line of the application example 3. The microstrip line comprises a dielectric substrate 403, a ground conductor 553 formed on the lower surface of the dielectric substrate 403, and a strip conductor 503 formed on the upper surface of the substrate 403. In this microstrip line, the strip conductor 503 is made of the high frequency low loss electrode of the present invention having at least one sub-conductor in each of the end portions (indicated by the circles in FIG. 23C) on the opposite sides of the strip conductor 503, and the conductor loss in the end portions can be reduced as compared with a conventional strip conductor having no sub-conductors. Consequently, in the microstrip line of the application example 3 of FIG. 23C, the transmission loss can be reduced as compared with a conventional microstrip line.

APPLICATION EXAMPLE 4

FIG. 23D is a perspective view showing the configuration of a coplanar line of the application example 4. The coplanar line comprises a dielectric substrate 403, ground conductors 554*a* and 554*b* provided at a predetermined interval on the upper surface of the dielectric substrate 403, and a strip conductor 504 formed between the ground conductors 554*a* and 554*b*. In the coplanar line, the strip conductor 504 is made of the high frequency low loss electrode of the present invention which has at least one sub-conductor in each of the end portions (indicated by the circles in FIG. and moreover, each of the ground conductors 554*a* and 554*b* is made of the high frequency low loss electrode of the present invention which has at least one sub-conductor on the inside end portion thereof (indicated by the circles in FIG. 23D). With this configuration of the coplanar line of the application example 4 of FIG. 23D, the transmission loss can be reduced as compared with a conventional coplanar line.

APPLICATION EXAMPLE 5

Figure 24B:
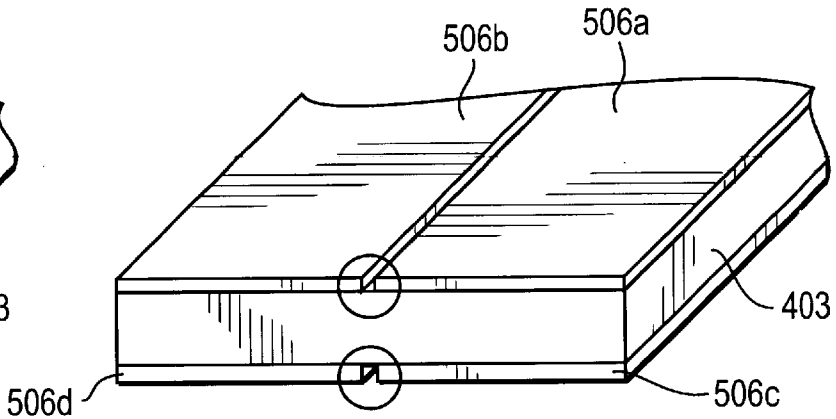
FIG. 24B is a perspective view showing the configuration of a parallel slot line as an application example 6 of the high frequency low loss electrode according to the present invention.
Figure 24A:
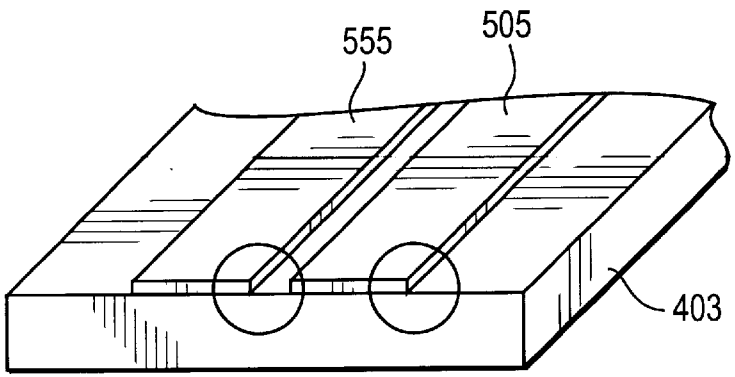
FIG. 24A is a perspective view showing the configuration of a coplanar strip line as an application example 5 of the high frequency low loss electrode according to the present invention.

FIG. 24A is a perspective view showing the configuration of a coplanar strip line of the application example 5. The coplanar strip line comprises a dielectric substrate 403, a strip conductor 505 and a ground conductor 555 provided at a predetermined interval, in parallel on the upper surface of the dielectric substrate 403. In the coplanar strip line, the strip conductor 505 is made of the high frequency low loss electrode of the present invention which has at least one sub-conductor in each of the end portions (indicated by the circles in FIG. 24A) on the opposite sides thereof, and the ground conductor 555 is made of the high frequency low loss electrode of the present invention which has at least one sub-conductor on the inside end-portion thereof (indicated by the circle in FIG. 24A), opposed to the strip conductor 505. With this configuration, the transmission loss of the coplanar strip line of the application example 5 shown in FIG. 24A can be reduced as compared with a conventional coplanar strip line.

APPLICATION EXAMPLE 6

FIG. 24B is a perspective view showing the configuration of a parallel slot line of the application example 6. The parallel slot line comprises the dielectric substrate 403, a conductor 506*a* and a conductor 506*b* formed at a predetermined interval on the upper surface of the dielectric substrate 403, and conductors 506*c* and 506*d* formed at a predetermined interval on the lower surface of the dielectric substrate 403. In the parallel slot line, the conductors 506*a* and 506*b* are made of the high frequency low loss electrode having at least one sub-conductor in the respective inside end portions (indicated by the circle in FIG. 24B) opposed to each other, respectively. The conductor 506*c* and the conductor 506*d* are made of the high frequency low loss electrode having at least one sub-conductor in the end portions (indicated by the circle in FIG. 24B) opposed to each other, respectively. With this configuration, in the parallel slot line of the application example 6 of FIG. 24B, the transmission loss can be reduced as compared with a conventional parallel slot line.

APPLICATION EXAMPLE 7

Figure 24D:
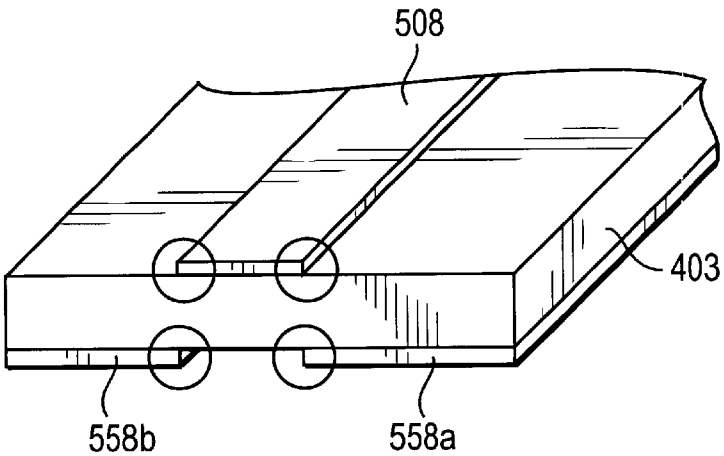
FIG. 24D is a perspective view showing the configuration of a high impedance microstrip line as an application example 8 of a high frequency low loss electrode according to the present invention.
Figure 24C:
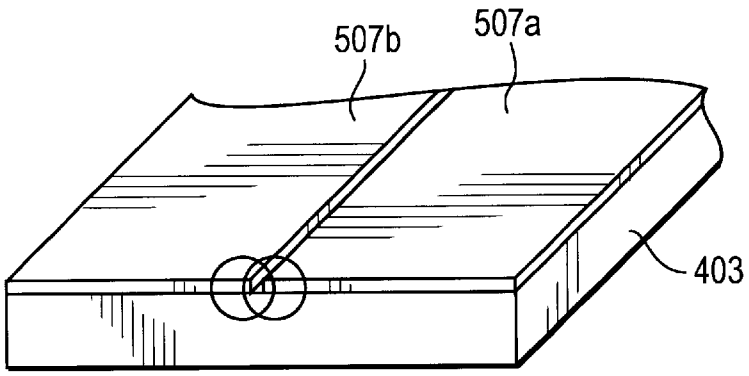
FIG. 24C is a perspective view showing the configuration of a slot line as an application example 7 of the high frequency low loss electrode according to the present invention.

FIG. 24C is a perspective view showing the configuration of a slot line of the application example 7. The slot line comprises the dielectric substrate 403, conductors 507*a* and 507*b* formed at a predetermined interval on the upper surface of the dielectric substrate 403. In the slot line, the conductors 507*a* and 507*b* are made of the high frequency low loss electrode which have at least one sub-conductor in the inside end portions (indicated by the circles in FIG. 24C) opposed to each other, respectively. With this configuration, in the slot line of the application example 7 of FIG. 24C, the transmission loss can be reduced as compared with a conventional slot line.

APPLICATION EXAMPLE 8

FIG. 24D is a perspective view showing the configuration of a high impedance microstrip line of the application example 8. The high impedance microstrip line comprises the dielectric substrate 403, a strip conductor 508 formed on the upper surface of the dielectric substrate 403, and ground conductors 558*a* and 558*b* formed at a predetermined interval on the lower surface of the dielectric substrate 403. In the high impedance microstrip line, the strip conductor 508 is made of the high frequency low loss electrode which has at least one sub-conductor in each of the end portions (indicated by the circles in FIG. 24B) on the opposite sides thereof. The ground conductors 558*a* and 558*b* have at least one sub-conductor in the respective inside end portions (indicated by the circles in FIG. 24D) thereof opposed to each other. With this configuration, in the high impedance microstrip line of the application example 8 of FIG. 24D, the transmission loss can be reduced as compared with a conventional high impedance microstrip line.

APPLICATION EXAMPLE 9

Figure 25B:
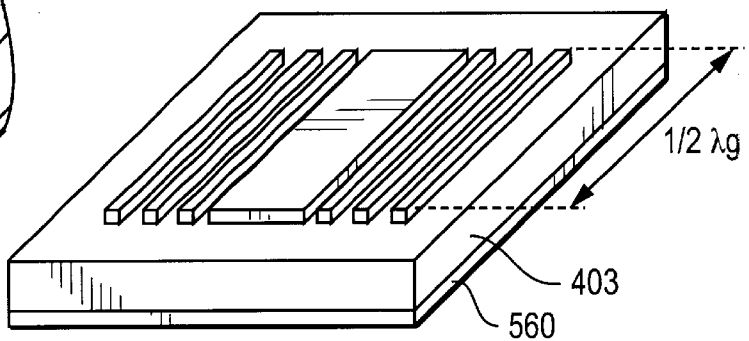
FIGS. 25B and 25C are perspective views each showing the configuration of a respective half-wave type microstrip line resonator which are application examples 10A and 10B of the high frequency low loss electrode according to the present invention.
Figure 25D:
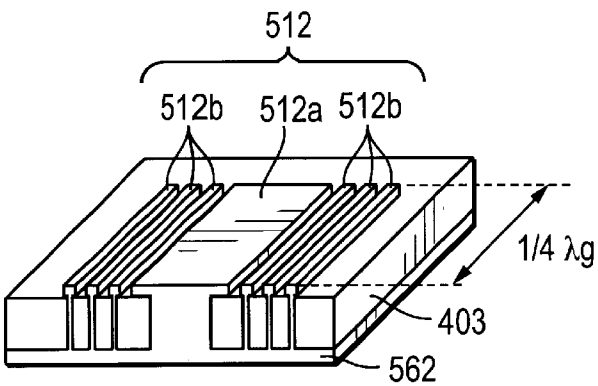
FIG. 25D is a perspective view showing the configuration of a quarter-wave type microstrip line resonator as an application example 11 of the high frequency low loss electrode according to the present invention.
Figure 25A:
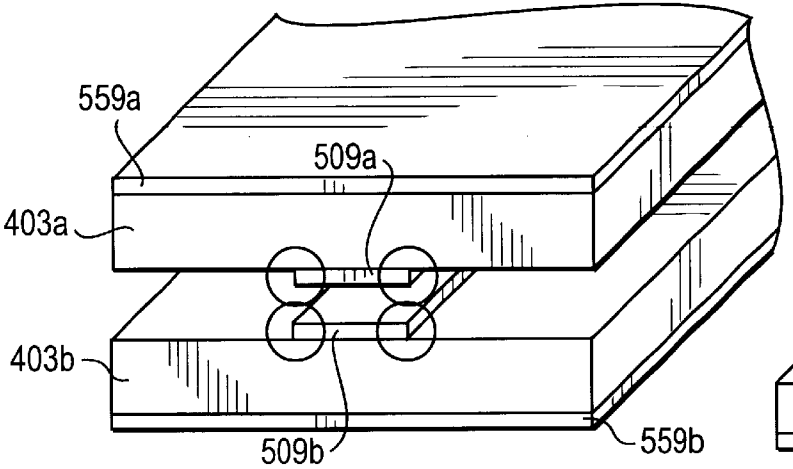
FIG. 25A is a perspective view showing the configuration of a parallel microstrip line as an application example 9 of the high frequency low loss electrode according to the present invention.

FIG. 25A is a perspective view showing the configuration of a parallel microstrip line of the application example 9. The parallel microstrip line comprises a dielectric substrate 403*a* having a ground conductor 559*a* formed on one side thereof and a strip conductor 509*a* formed on the other side thereof, and a dielectric substrate 403*b* having a ground conductor 559*b* formed on one side thereof, and a strip conductor 509*b* formed on the other side, in which the dielectric substrates 403*a* and 403*b* are arranged in parallel so that the strip conductors 509*a* and 509*b* are opposed to each other. In this parallel microstrip line, each of the strip conductors 509*a* and 509*b* is made of the high frequency low loss electrode of the present invention which has at least one sub-conductor in each of the opposite end portions (indicated by the circles in FIG. 25A) thereof. Consequently, in the parallel microstrip line of the application example 9 of FIG. 25A, the transmission loss can be reduced as compared with a conventional parallel microstrip line.

APPLICATION EXAMPLE 10

FIG. 25B is a perspective view showing the configuration of a half-wave type microstrip line resonator of the application example 10. The half-wave type microstrip line resonator comprises the dielectric substrate 403, a ground conductor 560 formed on the lower surface of the dielectric substrate 403, and a strip conductor 510 formed on the upper surface of the dielectric substrate 403. In this half-wave type microstrip line resonator, the strip conductor 510 is made of the high frequency low loss electrode of the present invention, and comprises a main conductor 510*a*, and three sub-conductors 510*b* formed along each of the end-portions on the opposite sides of the main conductor 510*a*. The conductor loss in the end portions can be reduced as compared with a conventional strip conductor having no sub-conductors. Consequently, the unloaded Q of the half-wave microstrip line resonator of the application example 10 of FIG. 25B can be enhanced as compared with that of a conventional half-wave microstrip line resonator.

Figure 25C:
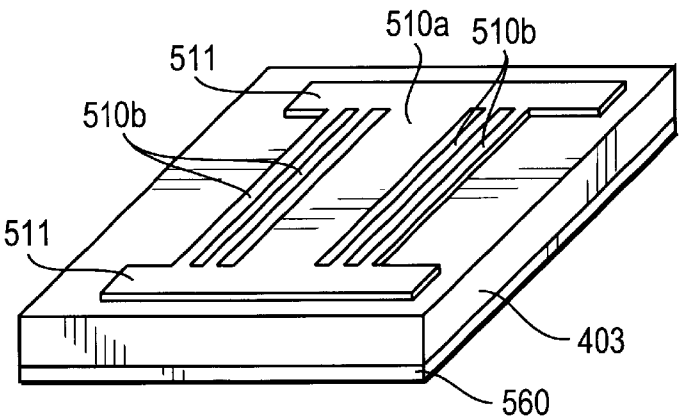

In another strip conductor 510' which is also a half-wave type microstrip line resonator, the main conductor 510*a* ' and the sub-conductors 510*b* ', as shown in FIG. 25C, may be connected to each other through conductors 511 provided on the opposite ends of them.

APPLICATION EXAMPLE 11

FIG. 25D is a perspective view showing the configuration of a quarter-wave type microstrip line resonator of the application example 11. The quarter-wave type microstrip line resonator comprises the dielectric substrate 403, a ground conductor 562 formed on the lower surface of the dielectric substrate 403, and a strip conductor 512 formed on the upper surface of the dielectric substrate 403. In this quarter-wave type microstrip line resonator, the strip conductor 512 is made of the high frequency low loss electrode of the present invention, and comprises a main conductor 512*a*, and three sub-conductors 512*b* formed along each of the end portions of the main conductor 512*a* on the opposite sides thereof. The main conductor 512*a* and the sub-conductors 512*b* are connected to the ground conductor 562 on one side-face of the dielectric substrate 403. The unloaded Q of the quarter-wave type microstrip line resonator of the application example 11 of FIG. 25D configured as described above can be enhanced as compared with that of a conventional quarter-wave microstrip line resonator.

APPLICATION EXAMPLE 12

Figure 26A:
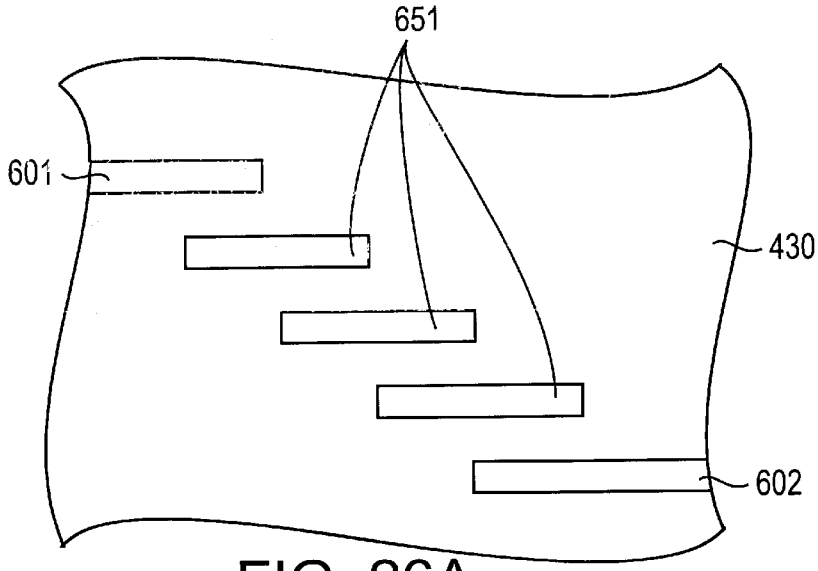
FIGS. 26A and 26B are plan views each showing the configuration of a respective half-wave type microstrip line filter which are application examples 12A and 12B of the high frequency low loss electrode according to the present invention.

FIG. 26A is a plan view showing the configuration of a half-wave microstrip line filter. The half-wave type microstrip line filter has the configuration in which three half-wave type microstrip line resonators 651 formed in the same manner as that of the application example 10 are arranged between an input microstrip line 601 and an output microstrip line 602, which are formed in the same manner as the application example 8, respectively. In the half-wave type microstrip line filter formed as described above, the transmission loss of the microstrip line 601 and the microstrip line 602 can be reduced. In addition, the unloaded Q of the half-wave type microstrip line resonator 651 can be enhanced. Accordingly, the insertion loss can be reduced, and moreover, the out-of-band attenuation can be increased, as compared with a conventional half-wave type microstrip line filter.

Figure 26B:
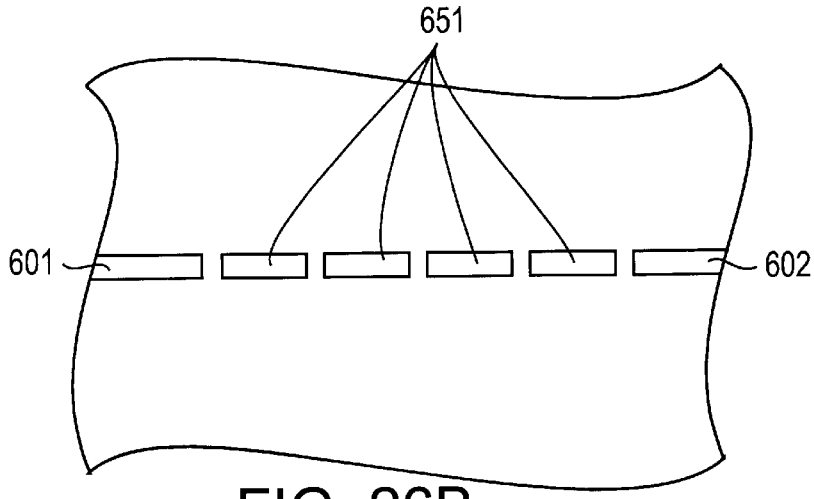

Further, in the half-wave type microstrip line filter of the application example 12, as shown in FIG. 26B, the half-wave type microstrip line resonators 651 may be arranged so that they are opposed to each other at their end-faces.

The number of the half-wave microstrip line resonators 651 is not limited to three or four.

APPLICATION EXAMPLE 13

Figure 26C:
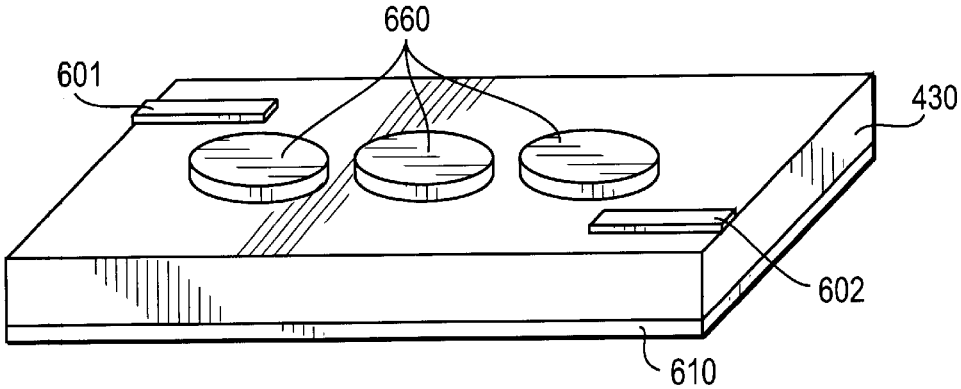
FIG. 26C is a plan view showing the configuration of a circular strip filter as an application example 13 of the high frequency low loss electrode according to the present invention.

FIG. 26C is a plan view showing the configuration of a circular strip filter of the application example 13. The circular strip filter has the configuration in which three circular strip resonators 660 formed in the same manner as the application example 1 are arranged between the input microstrip line 601 and the output microstrip line 602, formed in the same manner as the application example 8. In the circular strip filter formed as described above, the transmission loss of the microstrip line 601 and the microstrip line 602 can be reduced, and moreover, the unloaded Q of the circular strip resonator 660 can be enhanced. Accordingly, the insertion loss can be reduced, and the out-of-band attenuation can be increased.

Further, in the circular strip filter of the application example 13, the number of the circular strip resonator 660 is not limited to three.

APPLICATION EXAMPLE 14

Figure 27:
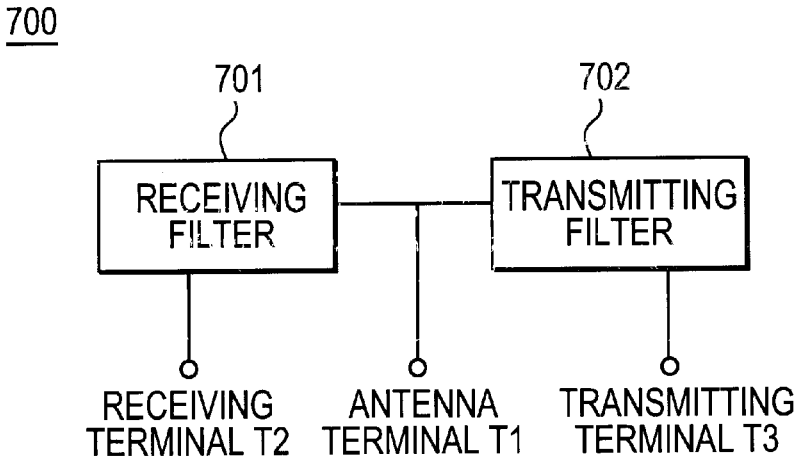
FIG. 27 is a block diagram showing the configuration of a duplexer 700 which is an application example 14.

FIG. 27 is a block diagram showing the configuration of a duplexer 700 of the application example 14. The duplexer 700 comprises an antenna terminal T1, a receiving terminal T2, a transmitting terminal T3, a receiving filter 701 provided between the antenna terminal T1 and the receiving terminal T2, and a transmitting filter 702 provided between the antenna terminal T1 and the transmitting terminal T3. In the duplexer 700 of the application example 14, the receiving filter 701 and the transmitting filter 702 are formed with the filter of the application example 12 or 13, respectively.

The duplexer 700 configured as described above has excellent separation characteristics for receiving and transmitting signals.

Figure 28:
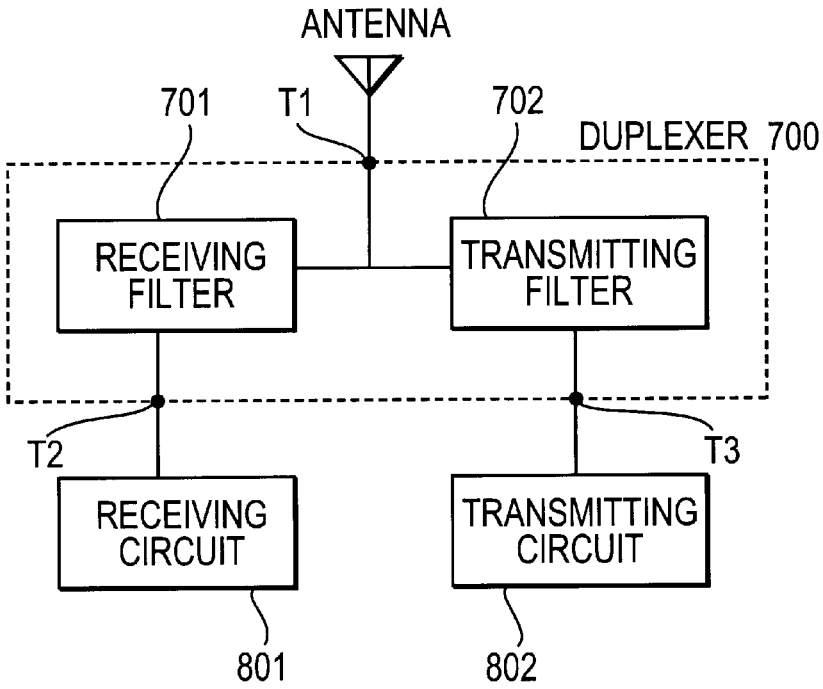
FIG. 28 illustrates communications device which is an application example 15 formed by use of the duplexer 700 of FIG. 27.

Further, in the duplexer 700, as shown in FIG. 28, an antenna is connected to the antenna terminal T1, a receiving circuit 801 to the receiving terminal T2, and a transmitting circuit 802 to the transmitting terminal T3, and is used as a portable terminal of a mobile communication system, as an example.

As described above, in the first high frequency low loss electrode according to the present invention, at least two sub-conductors formed along the side of the main conductor are formed so that a sub-conductor thereof positioned nearer to the outside has a smaller width. Therefore, the conductor loss can be effectively reduced.

Preferably, in the first high frequency low loss electrode of the present invention, the sub-conductor positioned nearest to the outside of the sub-conductors has a width smaller than ($\pi/2$) times the skin depth $\delta$ at an applied frequency. Consequently, an ineffective current in the sub-conductor nearest to the outside can be reduced, and thereby, the conductor loss can be effectively reduced.

More preferably, the sub-conductor positioned nearest to the outside in the sub-conductors has a width smaller than ($\pi/4$) times the skin depth $\delta$ at an applied frequency, and thereby, the ineffective current can be further reduced, and the conductor loss can be effectively reduced.

In the first high frequency low loss electrode of the present invention, the ineffective currents in all the sub-conductors can be reduced, preferably by setting each sub-conductor at a width smaller than ($\pi/2$) times the skin depth δ at an applied frequency, and thereby, the conductor loss can be decreased effectively.

Preferably, in the first high frequency low loss electrode of the present invention, the plural sub-conductors are formed so that the respective widths thereof decrease toward the outside. Consequently, the conductor loss can be reduced more effectively.

More preferably, in the first high frequency low loss electrode of the present invention, the intervals between the main conductor and the conductor adjacent to the main conductor and between adjacent sub-conductors are formed so that the intervals decrease toward the outside, corresponding to the widths of the respective adjacent sub-conductors. Consequently, currents substantially in phase can flow through the respective sub-conductors, and the conductor loss can be effectively reduced.

Still more preferably, in the first high frequency low loss electrode of the present invention, the sub-dielectrics are provided between sub-conductors, respectively, and the plural sub-dielectrics are formed so that a sub-dielectric thereof positioned nearer to the outside has a lower dielectric constant, corresponding to the widths of the adjacent respective sub-conductors, in order that currents substantially in phase can flow through the respective sub-conductors. Accordingly, the conductor loss can be effectively reduced.

In the second high frequency low loss electrode of the present invention, at least one of the sub-conductors has a width smaller than (π/2) times the skin depth δ at an applied frequency. Consequently, an ineffective current in the sub-conductor of which the width is smaller than (π/2) times the skin depth δ at an applied frequency can be reduced, and the conductor loss can be effectively decreased.

Preferably, in the second high frequency low loss electrode of the present invention, at least one of the sub-conductors has a width smaller than (π/4) times the skin depth δ at an applied frequency. Consequently, the ineffective current can be reduced, and the conductor loss can be effectively decreased.

More preferably, in the second high frequency low loss electrode of the present invention, the sub-conductor positioned nearest to the outside of the sub-conductors has a width smaller than (π/2) times the skin depth δ at an applied frequency, or more preferably a width smaller than (π/4) times the skin depth δ at an applied frequency. Consequently, the conductor loss can be reduced more efficiently.

The first high frequency resonator of the present invention includes the first or second high frequency low loss electrode of the present invention, and thereby, the unloaded Q can be enhanced.

Moreover, the high frequency transmission line of the present invention includes the above-described first or second high frequency low loss electrode. Consequently, the transmission loss can be reduced.

Further, the high frequency resonator of the present invention includes the high frequency transmission line of which the length is set at a quarter-wavelength multiplied by an integer. Consequently, the unloaded Q can be enhanced, and the resonator can be easily produced.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A high frequency low loss electrode comprising a main conductor, and at least two sub-conductors disposed along a side of the main conductor between said main conductor and an outside of said sub-conductors, said sub-conductors being disposed so that a sub-conductor thereof positioned nearer to the outside has a smaller width.

2. A high frequency low loss electrode according to claim 1, wherein the sub-conductor positioned nearest to the outside of said sub-conductors has a width smaller than (π/2) times the skin depth δ at an applied frequency.

3. A high frequency low loss electrode according to claim 2, wherein the sub-conductor positioned nearest to the outside of said sub-conductors has a width smaller than (π/4) times the skin depth δ at the applied frequency.

4. A high frequency low loss electrode according to claim 2 or claim 3, wherein all of said sub-conductors have respective widths smaller than (π/2) times the skin depth δ at the applied frequency.

5. A high frequency low loss electrode according to any one of claims 1 through 3, wherein sub-dielectrics are provided between the main conductor and the sub-conductor adjacent to the main conductor and between adjacent sub-conductors, respectively.

6. A high frequency low loss electrode according to claim 5, wherein the sub-dielectrics are disposed so that a sub-dielectric thereof positioned nearer to the outside has a lower dielectric constant.

7. A high frequency low loss electrode according to any one of claims 1 through 3, wherein the interval between the main conductor and the sub-conductor adjacent to the main conductor and the intervals between adjacent sub-conductors are disposed so that an interval thereof positioned nearer to the outside is shorter.

8. A high frequency low loss electrode according to any one of claims 1 through 3, wherein said sub-conductors are disposed so that a sub-conductor thereof positioned nearer to the outside has a smaller thickness.

9. A high frequency low loss electrode according to claim 1, wherein all of said sub-conductors have respective widths smaller than (π/2) times the skin depth δ at an applied frequency.

10. A high frequency low loss electrode comprising a main conductor, and at least one sub-conductor disposed along a side of the main conductor, said at least one sub-conductor having a width smaller than (π/2) times the skin depth δ at an applied frequency.

11. A high frequency low loss electrode according to claim 10, wherein said at least one sub-conductor has a width smaller than (π/4) times the skin depth δ at the applied frequency.

12. A high frequency low loss electrode according to any one of claims 10 and 11, wherein sub-dielectrics are provided between the main conductor and the sub-conductor adjacent to the main conductor and between the adjacent sub-conductors, respectively.

13. A high frequency low loss electrode according to any one of claims 1 or 10, wherein the main conductor is a thin-film multi-layer electrode comprising thin-film conductors and thin-film dielectrics laminated alternately.

14. A high frequency low loss electrode according to any one of claims 1 and 10, wherein at least one of the main conductor and the sub-conductors is comprised of a superconductor.

15. A high frequency filter including the high frequency low loss electrode according to any one of claims 1 and 11, further comprising an input electrode and an output electrode electromagnetically coupled to said high frequency low loss electrode.

16. A high frequency filter according to claim 15, wherein the high frequency low loss electrode has a length which is a quarter-wavelength at an applied frequency multiplied by an integer.

17. A high frequency filter according to claim 15, wherein the high frequency low loss electrode has a length which is a half-wavelength at an applied frequency multiplied by an integer.

18. An antenna sharing device comprising a transmitting filter and a receiving filter, wherein one of said filters is a high frequency filter according to claim 15.

19. A communications device comprising a transmitter and a receiver, and further comprising the antenna sharing device according to claim 18 connected between said transmitter and said receiver.

20. A communications device comprising the high frequency filter according to claim 15, and further comprising at least one of a transmitter and a receiver being connected to said filter.

21. A high frequency low loss electrode according to any one of claims 10 or 11, wherein a plurality of sub-conductors including said at least one sub-conductor are disposed between said main conductor and an outside of said sub-conductors, and wherein the sub-conductor positioned nearest to the outside of said sub-conductors has a width smaller than ($\pi/2$) times the skin depth $\delta$ at the applied frequency.

22. A high frequency low loss electrode according to claim 21, wherein the sub-conductor positioned nearest to the outside of said sub-conductors has a width smaller than ($\pi/4$) times the skin depth $\delta$ at the applied frequency.

23. A method of obtaining electromagnetic resonance at a predetermined frequency, comprising the steps of:

providing a high frequency low loss electrode comprising a main conductor, and at least two sub-conductors formed along a side of the main conductor between said main conductor and an outside of said sub-conductors, wherein said sub-conductors have respective widths which decrease toward the outside, said electrode having a length corresponding to said predetermined frequency; and applying a signal having said frequency to said electrode so as to cause said electrode to resonate in response to said signal.

24. A method according to claim 23, wherein said length is half-wavelength at said predetermined frequency.

25. A method according to claim 23, wherein said length is a quarter-wavelength at said predetermined frequency.

26. A method of transmitting a signal having a predetermined frequency, comprising the steps of:

providing a high frequency low loss electrode comprising a main conductors and at least two sub-conductors disposed along a side of the main conductor between said main conductor and an outside of said sub-conductors, wherein said sub-conductors have respective widths which decrease toward the outside, said electrode having a length corresponding to said predetermined frequency; and applying said signal to said electrode so as to transmit said signal.

27. A method according to claim 26, wherein said length is a quarter-wavelength at said predetermined frequency.

28. A method according to claim 26, wherein said length is a half-wavelength at said predetermined frequency.

* * * * *